US009487000B2

(12) United States Patent
Murate

(10) Patent No.: US 9,487,000 B2
(45) Date of Patent: Nov. 8, 2016

(54) LIQUID DROPLET EJECTING DEVICE, INKJET RECORDING APPARATUS, LIQUID DROPLET EJECTING METHOD, AND STORAGE MEDIUM FOR LIQUID DROPLET EJECTING METHOD

(71) Applicant: Hirohito Murate, Kanagawa (JP)

(72) Inventor: Hirohito Murate, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/742,614

(22) Filed: Jun. 17, 2015

(65) Prior Publication Data

US 2015/0367633 A1 Dec. 24, 2015

(30) Foreign Application Priority Data

Jun. 19, 2014 (JP) ..... 2014-126227
Jun. 2, 2015 (JP) ..... 2015-112620

(51) Int. Cl.

| | |
|---|---|
| ***B41J 29/38*** | (2006.01) |
| ***B41J 2/045*** | (2006.01) |
| ***B41J 2/055*** | (2006.01) |
| ***B41J 2/14*** | (2006.01) |

(52) U.S. Cl.

CPC ..... *B41J 2/04588* (2013.01); *B41J 2/0451* (2013.01); *B41J 2/04581* (2013.01); *B41J 2/055* (2013.01); *B41J 2/1412* (2013.01); *B41J 2/14233* (2013.01); *B41J 2002/14354* (2013.01); *B41J 2202/11* (2013.01)

(58) Field of Classification Search

None

See application file for complete search history.

(56) References Cited

U.S. PATENT DOCUMENTS

| | | | | |
|---|---|---|---|---|
| 7,300,131 | B2 | 11/2007 | Sakagami et al. | |
| 2012/0249638 | A1* | 10/2012 | Takano | B41J 2/0454 347/10 |
| 2013/0257945 | A1* | 10/2013 | Shinkawa | B41J 2/04541 347/10 |
| 2014/0267480 | A1* | 9/2014 | Yoshida | B41J 2/12 347/10 |
| 2015/0062226 | A1* | 3/2015 | Otokita | B41J 2/0451 347/14 |

FOREIGN PATENT DOCUMENTS

| | | | |
|---|---|---|---|
| JP | 2004-276273 | | 10/2004 |
| JP | 3933506 | | 6/2007 |
| JP | 4305034 | B2 * | 7/2009 |
| JP | 2011-140118 | | 7/2011 |

OTHER PUBLICATIONS

Machine generated English translation of JP 2004-314459A to Koike Yoshikazu; "Liquid Droplet Jet Device and Method of Predicting Abnormality of Head and Recovering the Same"; Nov. 11, 2004; 78 pp.*

* cited by examiner

*Primary Examiner* — Erica Lin
*Assistant Examiner* — Tracey McMillion
(74) *Attorney, Agent, or Firm* — Duft Bornsen & Fettig LLP

(57) ABSTRACT

A liquid droplet ejecting device includes multiple pressure chambers communicating with multiple nozzles, to contain liquid; a vibration plate, disposed extending along the pressure chambers; multiple piezoelectric elements disposed facing the multiple chambers respectively via the vibration plate; a drive waveform generator to generate a drive voltage for the piezoelectric elements; a residual vibration detector to detect a residual vibration waveform occurring within the pressure chamber after the piezoelectric elements are driven; and a controller to calculate a damping ratio of the residual vibration waveform detected by the residual vibration detector; and to determine whether abnormal ejection occurs.

19 Claims, 14 Drawing Sheets

LIQUID DROPLET EJECTING DEVICE, INKJET RECORDING APPARATUS, LIQUID DROPLET EJECTING METHOD, AND STORAGE MEDIUM FOR LIQUID DROPLET EJECTING METHOD

CROSS-REFERENCE TO RELATED APPLICATIONS

The present application and claims the benefit of the priority of is based on Japanese Priority Application No. 2014-126227, filed on Jun. 19, 2014 and No. 2015-112620 filed on Jun. 2, 2015, the entire contents of which are hereby incorporated herein by reference.

BACKGROUND OF THE INVENTION

1. Field of the Invention

The present invention relates to a liquid droplet ejecting device, an inkjet recording apparatus, a liquid droplet ejecting method, and a storage medium for liquid droplet ejecting method.

2. Description of the Related Art

Inkjet recording apparatuses usually have been known as image recording apparatuses or image forming apparatuses such as printers, facsimile machines, copiers, etc. In the inkjet recording apparatus, an inkjet recording head, which includes nozzles to eject ink droplets, pressure chambers communicating with the nozzles, and piezoelectric elements to pressurize the ink in the pressure chambers, form desired characters and figures on recording media (paper, metal, wood, and ceramics).

The reason why an abnormal image is formed on the recording medium is abnormal ejection (ink droplet is not normally ejected from the nozzle) caused by a state in which air bubble(s) is mixed in the pressure chamber, a state in which foreign objects (paper powder, liquid pool) are attached to the nozzle, and a state in which ink is thickened (ink viscosity is increased).

As one known inkjet recording apparatus (JP2004-276273), when there is a residual vibration after the ink droplet is ejected, by using an oscillation circuit, a F/V conversion circuit, a waveform shaping circuit, a comparator circuit, a filter circuit, etc., the abnormal ejection is detected based on the frequency change and/or amplitude change.

However, in the conventional inkjet recording apparatus, a complex circuit is required for detecting the abnormal ejections, such a configuration causes circuit size to be greater and the circuit to become costly.

SUMMARY OF THE INVENTION

In view of the above circumstances, in one aspect, the present invention proposes a liquid droplet ejecting device enabling to reduce manufacturing cost.

In an embodiment which solves or reduces one or more of the above-mentioned problems, the present invention provides A liquid droplet ejecting device includes multiple pressure chambers communicating with multiple nozzles, to contain liquid; a vibration plate, disposed extending along the pressure chambers; multiple piezoelectric elements disposed facing the multiple chambers respectively via the vibration plate; a drive waveform generator to generate a drive voltage for the piezoelectric elements; a residual vibration detector to detect a residual vibration waveform occurring within the pressure chamber after the piezoelectric elements are driven; and a controller to calculate a damping ratio of the residual vibration waveform detected by the residual vibration detector; and to determine whether abnormal ejection occurs.

BRIEF DESCRIPTION OF THE DRAWINGS

A more complete appreciation of the disclosure and many of the attendant advantages thereof may be readily obtained as they become better understood by reference to the following detailed description when considered in connection with the accompanying drawings, wherein.

DETAILED DESCRIPTION OF THE PREFERRED EMBODIMENTS

Figure 1:
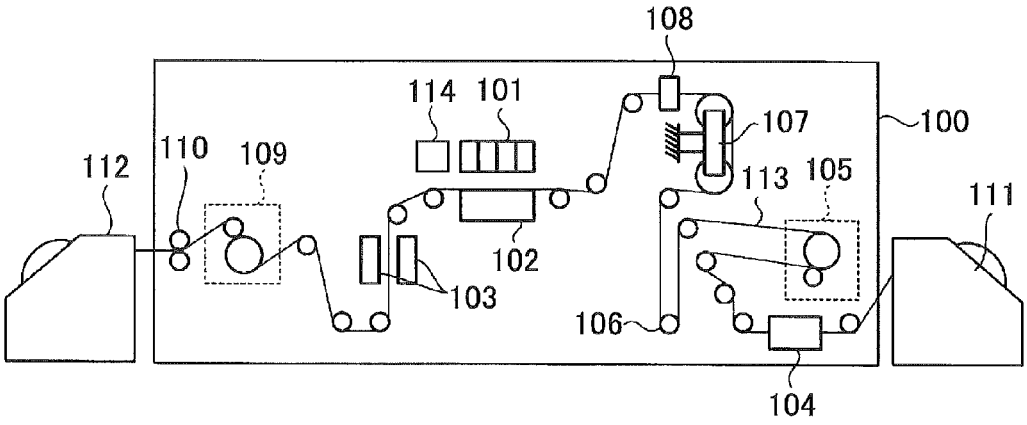
FIG. 1 is a schematic illustrating an entire configuration of an on-demand type line scanning inkjet recording apparatus according to embodiments of the present invention.

In the following, embodiments of the present invention will be described with reference to the accompanying drawings. It should be noted that configuration elements that include substantially the same functional configurations in the present specification and the drawings are assigned the same reference numerals and the duplicated description is omitted.

Below are described the embodiments of the present invention, with reference to figures. It is to be noted that, for ease of explanation and illustration, same configurations are represented by identical numerals and the description thereof is omitted below.

In the present specification, "normal ejection state" means the state in which ink droplets are normally ejected from nozzles, "abnormal ejection state" means the state in which ink droplets are not ejected from nozzles, the state in which certain amount of the ink droplets are not ejected from the nozzle, and the state in which the ink droplet has not landed on appropriate positions of the recording medium.

In the present specification, an example in which a piezoelectric element is used as a pressure generating element to pressurize ink (liquid) in a pressure chamber is described.

<Inkjet Recording Apparatus>

First Embodiment

FIG. 1 is a schematic illustrating an entire configuration of system including an on-demand type line scanning inkjet recording apparatus 100.

In the system shown FIG. 1, the inkjet recording apparatus 100 is disposed between a recording medium supply unit 111 and a recording medium collection unit 112. The inkjet recording apparatus 100 includes an (inkjet) recording device 101, a platen 102 provided facing the recording device 101, a drying module 103, a maintenance-recovery device 114, and a recording medium conveying device.

A continuous recording medium (roller paper, continuous form paper) 113 is fed from the recording medium supply unit 111 at high speed and after printing operations, the recording medium 113 is reeled and collected in the recording medium collection unit 112.

The recording device 101 (inkjet recording module 200) includes a line type inkjet recording head 220 in which nozzles (printing nozzles) 20 (see FIG. 4) are arranged in the entirety of a printing width. Color printing is performed using the respective line heads for black, cyan, magenta, and yellow. In printing, nozzle surfaces of the inkjet recording heads 220 are supported so that a predetermine gap is kept constant between the nozzle surfaces and the platen 102. The inkjet recording module 200(101) ejects the ink in accordance with the conveyance speed of the recording medium 113, which forms a color image on the recording medium 113. The drying module 103 dries and fixes the ink on the recording medium 113 such that the ink printed on the recording medium 113 is not adhered to another portion. The drying module 103 may be constituted by a non-contact type driving device or contact-type drying device.

The maintenance-recovery device 114 performs appropriate maintenance-recovery operations, on the inkjet recording head module that is installed in the inkjet recording apparatus 100, and for recovering the ejection performance (discharging performance) of the nozzles 20. As the maintenance recovery operation, for example, a suction operation, a wiping operation, and a flushing operation are given. The suction operation is to remove air bubbles that are mixed in a pressure chamber 27. The wiping operation is to remove the foreign objects (for example, a liquid pool or paper powder) attached to the surface of the nozzle 20. The flushing operation, which is also called "idle discharge", "dummy discharge", and "ejection for discarding", is to discharge the thickened ink (the ink whose viscosity is increased) contained in the pressure chamber 27, outside of the nozzle 20.

In the recording medium conveying device, a restriction guide 104, an in-feed unit 105, a dancer roller 106, an EPC 107, a conveyance meandering detector 108, an out-feed unit 109, and a puller 110 are provided. The restriction guide 104 performs positioning of the recording medium 113 fed by the recording medium supply unit 111, in a width direction thereof. The in-feed roller (unit) 105 consists of a drive roller and a driven roller, to keep a tension force of the recording medium 113 constant. The dancer roller 106 moves in a vertical direction and outputs a positioning signal by moving in the vertical direction in accordance with the tension force of the recording medium 113. The EPC (edge position controller) 107 controls positions of edges of the recording medium 113. The conveyance meandering detector 108 is used for feeding back the meandering amount. The out-feed unit 109, including a driving roller and a driven roller, drives and conveys the recording medium 113 at a setting constant speed. The puller 110, including a driving roller and a driven roller, discharges the recording medium 113 outside of the inkjet recording apparatus 100.

The recording medium conveying device, functioning as a tension-control type conveying device, detects the positions of the dancer roller 106 and controls the rotation of the in-feed unit 105, which can keep a tension force of the recording medium 113 during conveying.

The line scanning type inkjet recording apparatus 100 performs a star-flushing operation and a line-flushing operation (for example the idle discharge where ink lands in a border between A4 papers), thereby discharging the thickened ink. The star-flushing operation has a demerit in that it is less likely to obtain good effect of ink ejection for discarding, under the low-humidity environment and the ink landing on a small image (low duty) on the recording medium, but has a merit in that no waste sheet is generated. The line-flushing operation has a demerit in that it cannot help generating the waste sheet because cutting the area on which the ink droplet is landed is necessary, but has a merit in that the thickened ink can be strongly ejected (discharged) for discarding.

<Inkjet Recording Head Module>

Figure 2:
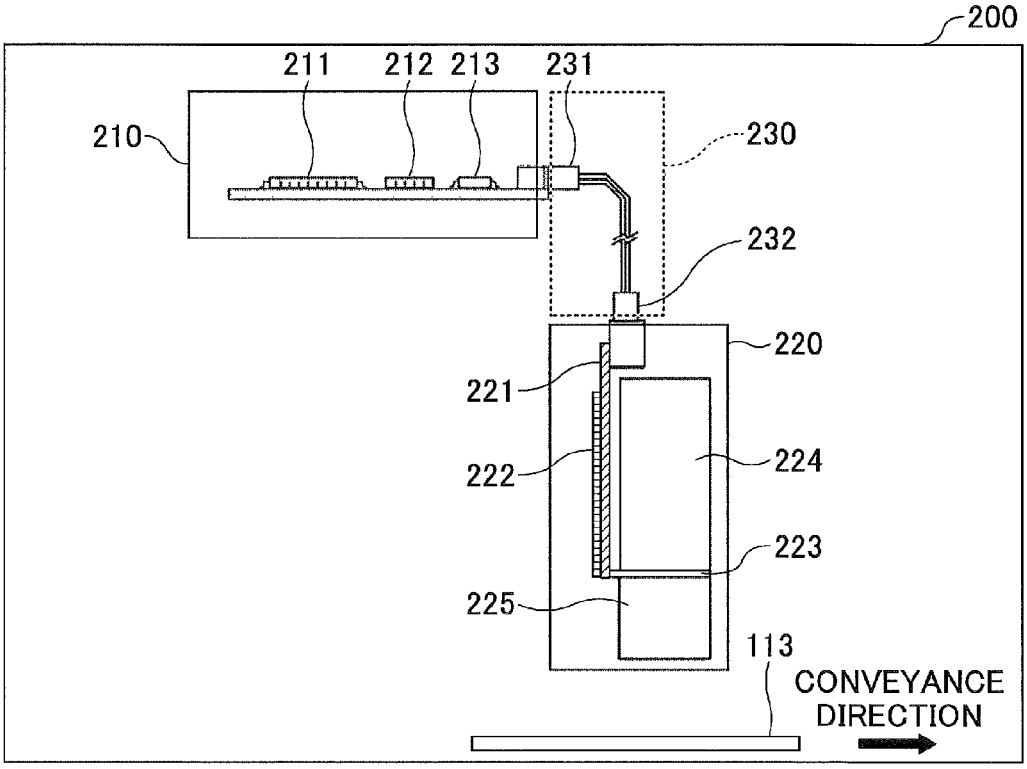
FIG. 2 is a side view illustrating a configuration of an inkjet recording module (liquid droplet ejecting device) according to the first embodiment.

FIG. 2 is a side view illustrating a configuration of one example of the inkjet recording module 200 (recording device 101), to be installed in the inkjet recording apparatus 100.

As shown in FIG. 2, the inkjet recording module 200 mainly includes a drive control substrate 210, the inkjet recording head 220, and a cable 230.

The drive control substrate 210 is equipped with a controller 211, a drive waveform generator 212, and a memory 213. Furthermore, each of the inkjet recording heads 220 includes a head-side substrate 221, a vibration detecting substrate 222, a head driving IC substrate 223, an ink tank 224, and a rigidity plate 225. The cable 230 connects a drive-control substrate side connector 231 and a head side connector 232. By doing so, the drive control substrate 210 sends and receives an analog signal and a digital signal to and from the head-side substrate 221 via the cable 230.

Herein, in the line scanning type inkjet recording apparatus 100 that has a line head structure, one or multiple inkjet recording heads 220 are arranged in a direction orthogonal to a direction in which the recording medium 113 is conveyed. Herein, the line scanning type inkjet recording head 220 ejects ink droplet onto the recording medium 113, thereby enabling fast image forming. However, the structure of the inkjet recording apparatus 100 is not limited to the line scanning type; alternatively, a serial scanning type inkjet recording apparatus where the image is formed while the one or multiple recording heads are conveyed to the direction orthogonal to the conveyance direction of the recording medium 113, or another apparatus may be used.

Herein, the abnormal ejection of the head is described. During printing, since the ink in the pressure chamber is exposed to external air via the opening of the nozzle, the solvent of the ink is evaporated and ink viscosity is increased, affected by the change in the ambient temperature and ambient humidity, and affected by the self-heating caused by continuous driving. In addition, there are some ejection failures, such as a state in which the air bubble is mixed in the pressure chamber, a state in which the paper powder is attached on the surface of the nozzle, and a state in which the liquid pool is generated near the nozzle.

As a result, the ejecting speed of the respective nozzles vary, which may cause defective image formation such as image density fluctuation, image partly absent creating white lines, and color tone change. When the ink viscosity is further increased, the nozzle is clogged, and the image is formed with the ink partly absent, creating white dots (image partly creating white dots) occurs. In order to solve these problems, it is necessary to detect abnormal ejection of the head accurately, and perform the appropriate maintenance and recovery operation for the liquid droplet ejecting device.

Although details are described below, in the liquid droplet ejecting device, using a simple circuit (residual vibration detector) constituted by a general-purpose operational amplifier, passive elements, and switches, the residual vibration after the ink surface (meniscus) is vibrated (slightly driven) so that the ink that is not ejected is detected, or the residual vibration after the ink is ejected is detected.

Then, in the liquid droplet ejecting device, the controller accurately determines whether the abnormal ejection occurs (occurrence of the abnormal ejection) based on the attenuation ratio (damping ratio) of the residual vibration. That is, the abnormal ejection can be determined by a simple circuit and a simple control in the liquid droplet ejecting device, which can reduce the cost (manufacturing cost) of the inkjet recording apparatus having the liquid droplet ejecting device installed.

Figure 3:
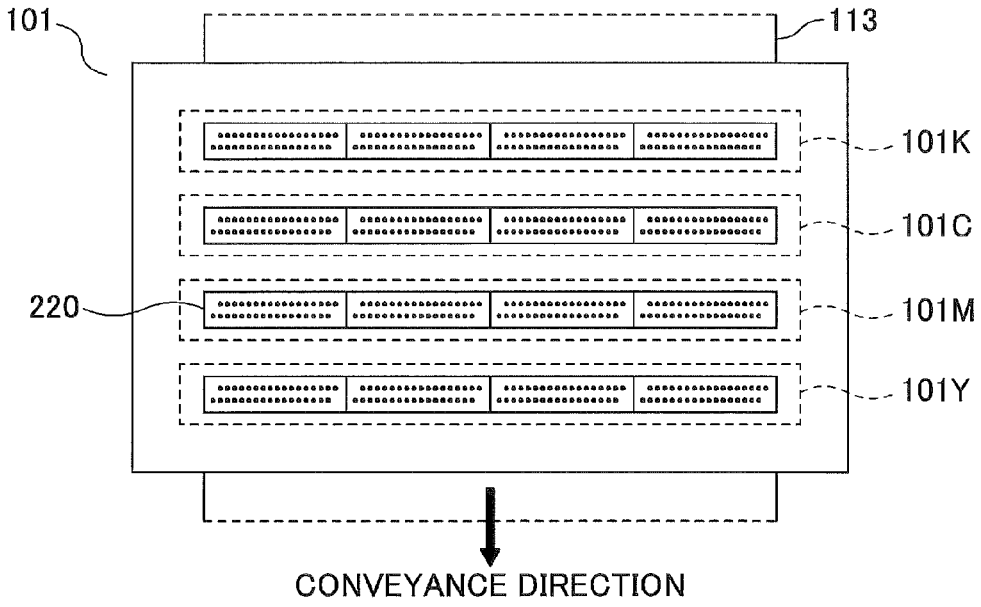
FIG. 3 is a schematic illustrating a recording device configured with a line head structure.

FIG. 3 is a schematic illustrating the recording device 101, to be installed in the inkjet recording apparatus 100.

The recording device 101 shown in FIG. 3 is configured with an assembly of four head arrays 101K, 101C, 101M, and 101Y, and each of the head arrays 101K, 101C, 101M, and 101Y includes multiple inkjet recording heads 220. The head array 101K for black ejects black-color ink droplets, the head array 101C for cyan ejects cyan-color ink droplets, the head array 101M for magenta ejects magenta-color ink droplets, and the head array 101Y for yellow ejects yellow-color ink droplets.

The respective head arrays 101Y, 101C, 101M, and 101Y are arranged parallel to the conveyance direction of the recording medium 113. Multiple inkjet recording heads 220 are disposed in zigzag, in the direction orthogonal to the conveyance direction. The inkjet recording heads 220 are configured as arrays as described above, which can ensure a wide printing region.

Figure 4:
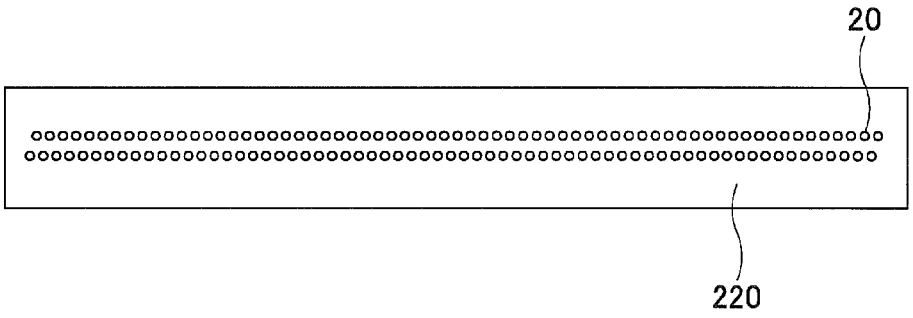
FIG. 4 is an enlarged bottom view illustrating an inkjet recording head shown in FIG. 3.

FIG. 4 is a bottom view illustrating an enlarged bottom of the inkjet recording head 220 in the head device shown in FIG. 3.

The inkjet recording head 220 includes multiple nozzles 20, and the multiple nozzles 20 are arranged in zigzag in the direction orthogonal to the conveyance direction of the recording medium 10. Thus, a great number of print nozzles 20 are arranged in zigzag, which can cope with high resolution.

In the embodiment shown in FIG. 3, four inkjet recording heads 220 are arranged in one row. Further, 32 nozzles are arranged in one row, two rows are arranged in parallel, and the nozzles 20 in an upper row and the nozzles 20 in a lower row are arranged relative to each other like a zigzag. This configuration is just one example, and the number of rows and the number in the array are not limited to the example above.

Figure 5:
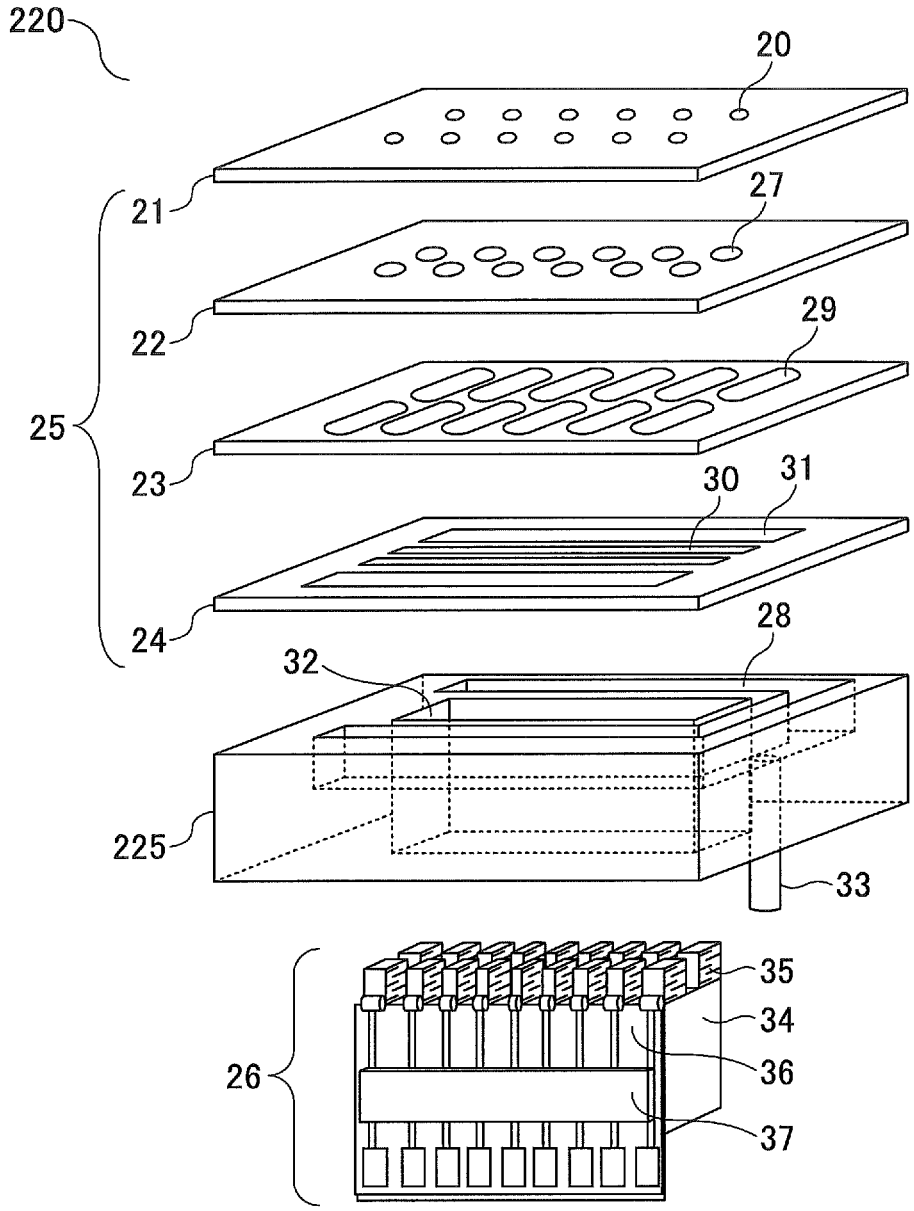
FIG. 5 is a perspective diagram of the recording head of the first embodiment.

FIG. 5 is a configuration perspective diagram of the inkjet recording head 220, to be installed in the inkjet recording apparatus 100. As shown in FIG. 5, the inkjet recording head 220 mainly includes a nozzle plate 21, a pressure-chamber plate 22, a restrictor plate 23, a diaphragm plate 24, a rigidity plate 25, and a piezoelectric-element group 26. The piezoelectric-element group 26 includes a supporting member (piezoelectric-element supporting substrate) 34, multiple piezoelectric elements 35, a piezoelectric element connecting substrate 36, and a piezoelectric element driving IC 37.

Multiple nozzles 20 are formed in the nozzle plate 21. Pressure chambers 27, corresponding to the nozzles 20, are formed in the pressure chamber plate 22. Restrictors 29 are formed in the restrictor plate 23. The restrictor 29 is provided to communicate with the pressure chamber 27 and a common ink channel 28, to control the amount of ink flowing to the pressure chamber 27. The diaphragm plate 24 includes a vibration plate (elastic wall) 30 and a filter 31. (It is to be noted that the plates 21, 22, 23, and 24 (plate group 25) are disposed beneath the rigidity plate 225 when the inkjet recording head 220 is installed in the head module 200 shown in FIG. 2.)

The channel plate is configured by superimposing the plates 21, 22, 23, and 24 in this order, and then by performing the positioning and connecting the plates 21, 21, 23, and 24. By joining the channel plate to the rigidity plate 28, the filter 31 is placed facing an opening 32 of the common ink channel 28. An upper opening end of an ink guide pipe 33 is connected to the common ink channel 28. A lower opening end of the ink guide pipe 33 is connected to a head tank that the ink fills.

The multiple piezoelectric elements 35 are formed on the supporting member (piezoelectric-element supporting substrate) 34, and free ends of the piezoelectric elements 35 are bonded and fixed to the vibration plate 30. The piezoelectric-element driving IC 37 is formed on the surface of the piezoelectric element connection substrate 36, where the piezoelectric-element driving IC 37 and the piezoelectric element connection substrate 36 are electrically connected to each other. Based on the drive waveform (for example, a drive voltage waveform) generated in the drive waveform generator 212, the piezoelectric-element driving IC 37 controls the piezoelectric element 35. The piezoelectric-element driving IC 37 is controlled based on the image data transmitted from the host controller, and the timing signal output from the controller 211.

For ease of illustration, FIG. 5 shows the nozzles 20, the pressure chambers 27, the restrictors 29, and the piezoelectric elements 35, where numbers thereof are less than actual numbers thereof.

(Detection of the Residual Vibration)

With reference to FIGS. 6 through 16, one example of the residual vibration detection in the liquid droplet ejecting device according to the present embodiment is described.

Figure 6A:
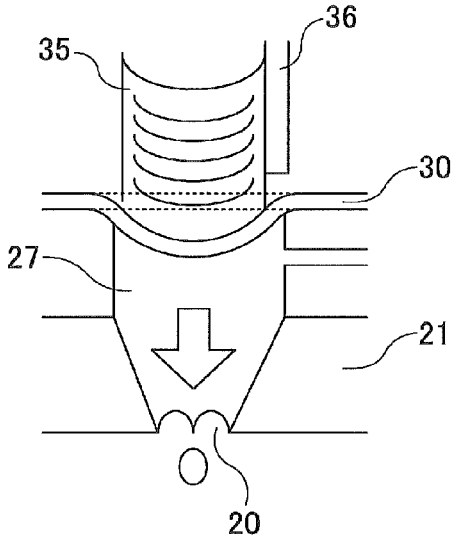
FIG. 6A is a schematic illustrating pressure change and operation of a residual vibration occurring within a pressure chamber of a print nozzle while ink is being ejected.
Figure 6B:
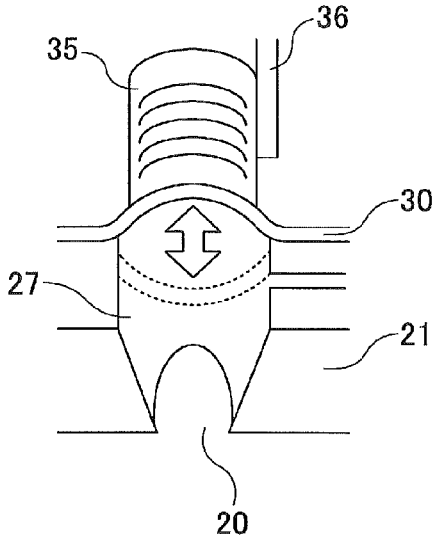
FIG. 6B is a schematic illustrating pressure change and operation of a residual vibration occurring within the pressure chamber of the print nozzle after ink has been ejected.

FIGS. 6A and 6B are schematics illustrating operation of the residual vibration waveform occurring in the pressure chamber 27 in the inkjet recording head 220. Specifically, FIG. 6A illustrates the pressure change occurring in the pressure chamber 27 while ink is being ejected. FIG. 6B illustrates the pressure change occurring in the pressure chamber 27 after ink has been ejected.

Figure 7:
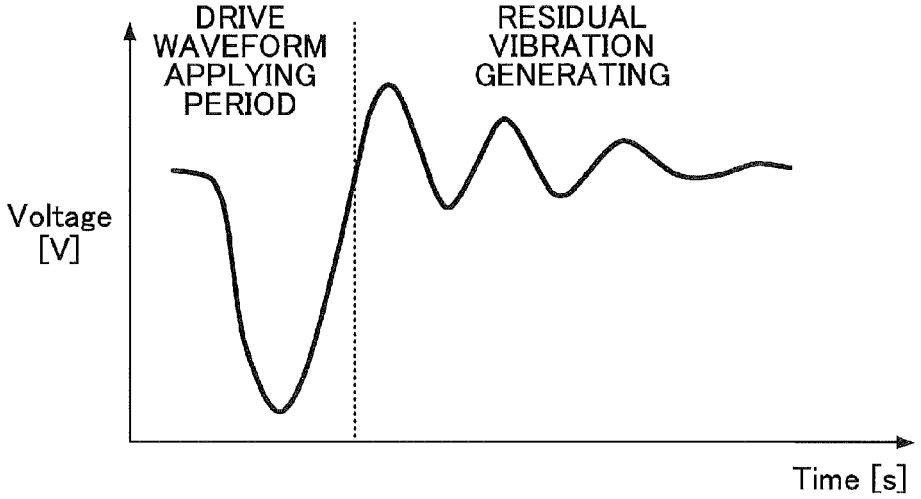
FIG. 7 is a graph schematically illustrating a drive waveform generating period and a residual vibration waveform generating period.

FIG. 7 is a graph schematically illustrating a drive waveform and a residual vibration waveform. In FIG. 7, a horizontal axis shows time [s], and a vertical axis shows voltage [V]. A drive waveform applying period in FIG. 7 corresponds to the state of the pressure chamber 27 shown in FIG. 6A. A residual vibration waveform generating period of FIG. 7 corresponds to the pressure state of the pressure chamber 27 shown in FIG. 6B.

As shown in FIG. 6A, as the drive waveform generated in the drive waveform generator 212 is applied to the piezoelectric element 35 (specifically, electrode of the piezoelectric element connection substrate 36), the piezoelectric element 35 expands and contracts. A stretching force of the piezoelectric element 35 based on the drive waveform changes the pressure in the pressure chamber 27 via the vibration plate 30, which generates the pressure change in the pressure chamber 27 to eject the ink. For example, falling of the drive waveform decreases the pressure in the pressure chamber; on the contrary, rising of the drive waveform increases the pressure in the pressure chamber 27 (see drive waveform generating period shown in FIG. 7).

As shown FIG. 6B, after the drive waveform is applied to the piezoelectric element 35 (ink droplet has been ejected), the residual vibration occurs in the pressure chamber 27. The residual pressure wave generated in the pressure chamber 27 is propagated to the piezoelectric element 35 via the vibration plate 30. The residual pressure wave is shaped by a damping vibration waveform (see residual vibration waveform generating period as shown in FIG. 7). As a result, a residual vibration voltage is induced in the piezoelectric element 35 (specifically, an electrode of the piezoelectric element connection substrate 36). A residual vibration detector 240 detects the residual vibration voltage and generates a detection result (for example, a digital signal, where the amplitude of the residual vibration is fixed at a peak value, and the amplitude value of the analog signal is converted into the digital signal) for outputting to the controller 211 as an output of the detector 240.

As described above, in the liquid droplet ejecting of the present embodiment, a residual vibration detector 240 (see FIG. 13) detects the residual vibration based on the expansion and contraction of the piezoelectric element 35, and the controller 211 calculates the attenuation ratio based on the output of the residual vibration detector 240 and determines the abnormal ejection based on the attenuation ratio.

Thus, the liquid droplet ejecting device can determine the abnormal ejection with a simple circuit; and the maintenance recovery device can perform appropriate maintenance and recovery operations for the liquid droplet device (heads) for which the maintenance/recovery is needed.

Figure 8:
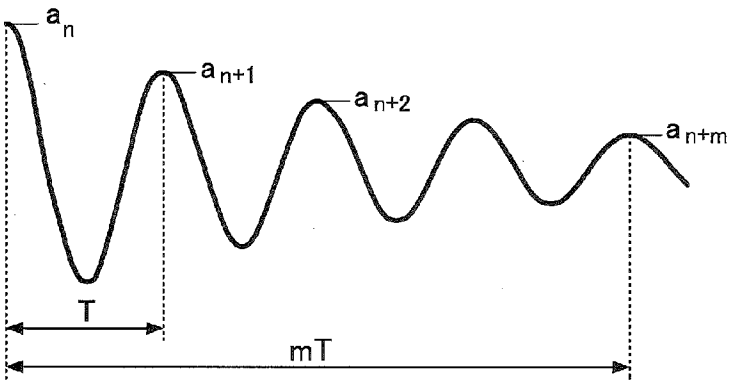
FIG. 8 is a graph illustrating a measured residual vibration waveform when several different ink viscosities are used.

Next, with reference to FIGS. 8 through 12B, a process to calculate an attenuation ratio based on amplitudes of the residual vibration and the amplitude used for determining the occurrence of the abnormal ejection are described below. FIG. 8 is a schematic used for calculating an attenuation ratio based on an attenuation vibration waveform.

An ideal formula of an attenuation vibration is represented by the following formula 1.

Wherein, x represents a vibration displacement, relative to a time t, x0 represents an initial displacement, ζ represents an attenuation ratio, ω0 represents a natural vibration frequency, ωd represents a natural vibration frequency for an attenuation system, v0 represents an initial changing amount, and t represents a time.

$$x = e^{-\zeta\omega_0 t}\left(x_0 \cos \omega_d t + \frac{\zeta\omega_0 x_0 + v_0}{\omega_d} \sin \omega_d t\right) \tag{1}$$

Herein, the natural vibration frequency ϕd for the attenuation system is represented by the following formula 2.

$$\omega_d = \sqrt{1-\zeta^2}\,\omega_0 \tag{2}$$

As a parameter that is required for calculating the attenuation ratio ζdet, a logarithm attenuation ratio δ exists. The logarithm attenuation ratio δ is represented by the following formula 3.

$$\delta = \frac{1}{m} \cdot \ell n \frac{a_n}{a_{n+m}} \tag{3}$$

In the formula 3 and FIG. 8, $a_n$ represents "n"-th amplitude value, and $a_{n+m}$ represents "n+m"-th amplitude value. In FIG. 8, T represents one cycle, the logarithm attenuation δ represents a value that is acquired by logarithmic transforming a rate of the amplitude change, dividing the logarithmic transformed value by m, and averaging per cycle. The numbers n and m are natural numbers.

The attenuation ratio ζ is calculated by dividing the logarithm attenuation ratio δ by 2π, as shown in the following formula 4.

$$\zeta = \frac{\delta}{2\pi} \tag{4}$$

That is, the attenuation ratio ζ has the information that the attenuation ratio of the amplitude values for the multiple cycles is averaged by 1 cycle.

Thus, based on the formulas (1) through (4), the attenuation ratio ζ may be calculated by acquiring on the logarithm attenuation ratio δ, so this process is required to merely detect at least two amplitudes of the residual vibration waveform.

Figure 9B:
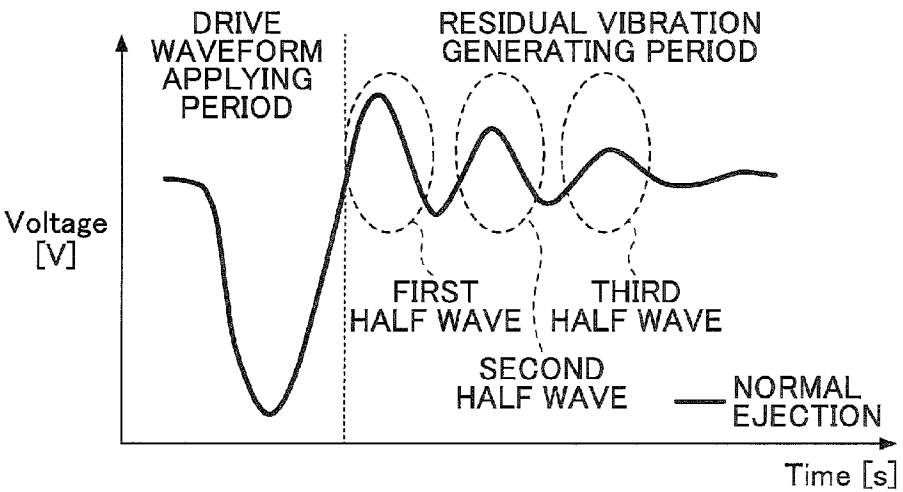
FIG. 9B is a graph schematically illustrating a drive waveform and a residual vibration waveform in the normal ejection state shown in FIG. 9A.
Figure 9A:
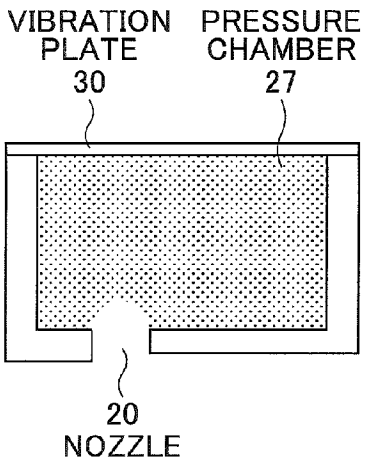
FIG. 9A shows a schematic diagram illustrating how the ink behaves in the pressure chamber.

Herein, using FIGS. 9A through 12B, the residual vibration waveform of the residual vibration in a normal ejection state and the residual vibration waveforms of the residual vibration in some abnormal ejection states are described. FIGS. 9A and 9B show the state where the ink contained in the pressure chamber 27 is in the normal state.

Figure 10A:
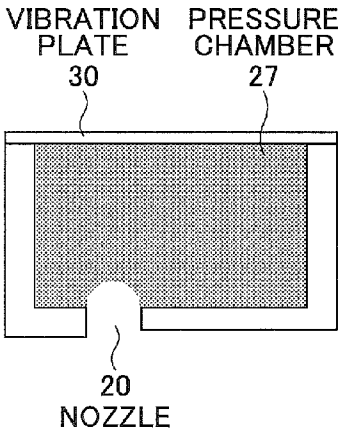
FIG. 10A shows a schematic diagram illustrating how the ink behaves in the pressure chamber.
Figure 10B:
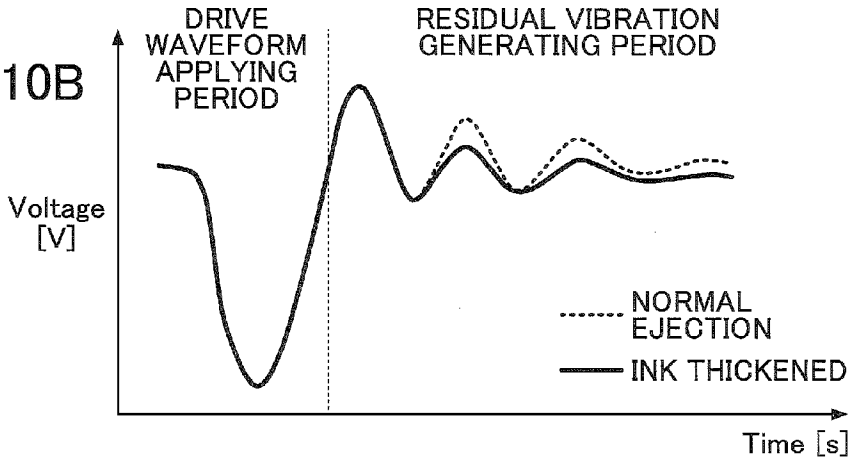
FIG. 10B is a graph schematically illustrating a drive waveform and a residual vibration waveform when the ink is thickened due to drying shown in FIG. 10A.
Figure 11A:
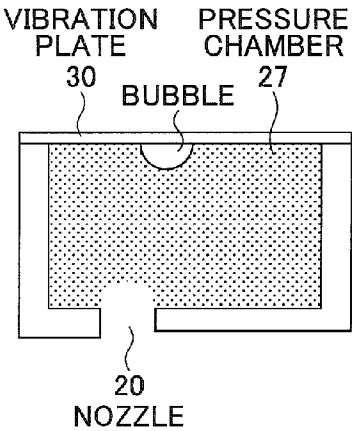
FIG. 11A shows a schematic diagram illustrating how the ink behaves in the pressure chamber.
Figure 11B:
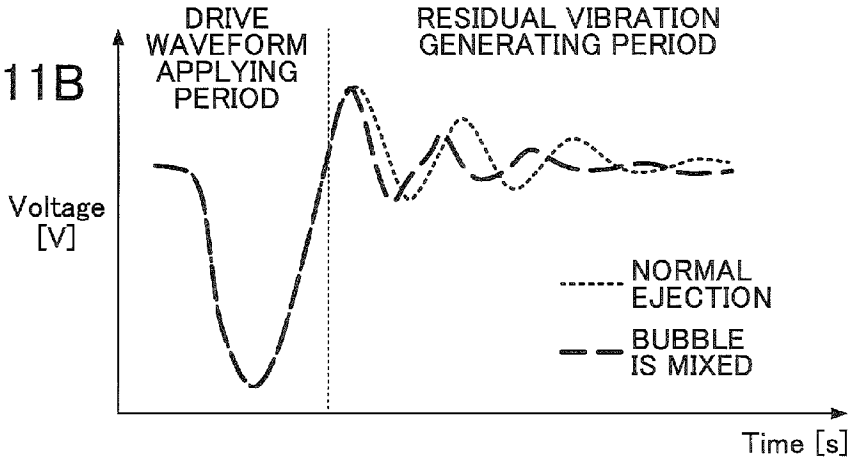
FIG. 11B is a graph schematically illustrating a drive waveform and a residual vibration waveform when an air bubble is mixed in the pressure chamber shown in FIG. 11A.
Figure 12B:
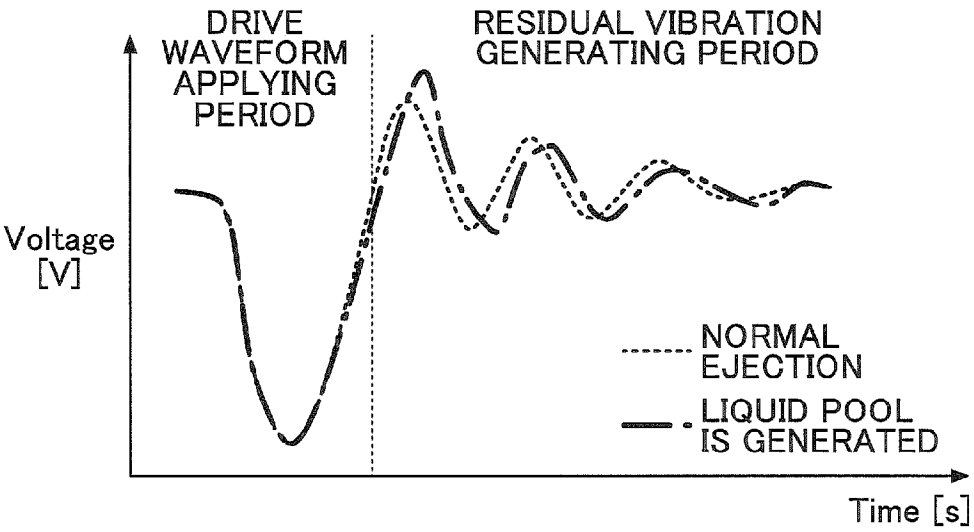
FIG. 12B is a graph schematically illustrating a drive waveform and a residual vibration waveform when a liquid pool is generated near the nozzle shown in FIG. 12A.
Figure 12A:
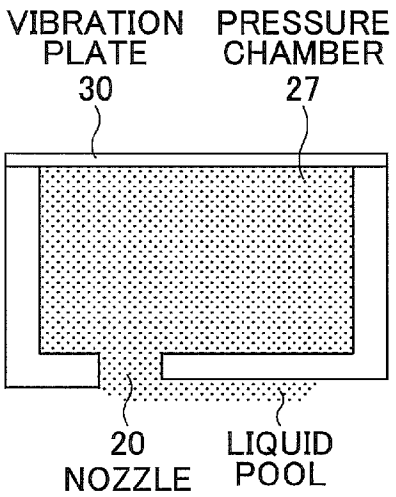
FIG. 12A shows a schematic diagram illustrating how the ink behaves in the pressure chamber.

FIGS. 10A and 10B show the state where the viscosity of the ink is increased in the pressure chamber 27. FIGS. 11A and 11B show the state where an air bubble is mixed in the ink contained in the pressure chamber 27. FIGS. 12A and 12B show the state where a liquid pool is generated near the nozzle 20.

FIGS. 9A through 12A show schematic diagrams illustrating how the ink behaves in the pressure chamber 27. FIGS. 9B through 12B (FIGS. 9B, 10B, 11B, and 12B) are graphs schematically illustrating a drive waveform applying period and a residual vibration waveform generating period. In FIGS. 9B through 12B, a horizontal axis shows time [s], and a vertical axis shows voltage [V]. The drive waveform applying periods in FIGS. 9B through 12B correspond to the state of the pressure chamber 27 shown in FIG. 6A. The residual vibration waveform generating period of FIGS. 9B through 12B correspond to the pressure state of the pressure chamber 27 shown in FIG. 6B.

In a case of FIG. 9A, since the ink in the pressure chamber 27 is the normal state, and FIG. 9B shows the residual vibration waveform in the normal state. Therefore, the controller 211 determines that the attenuation ratio of the residual vibration waveform is within a predetermined range, and the abnormal ejection does not occur. (Normal ejection that does not cause the ejection failure)

In a case of FIG. 10A, the ink viscosity is increased in the pressure chamber 27. In FIG. 10B, the amplitude of a first-half waveform is almost identical to that in the normal state, the second-half wave and after the second-half wave (second, third half waves) becomes smaller than that in the normal ejection state. As is understood from the waveform, the attenuation ratio of the residual vibration shown in FIG. 10B, becomes relatively greater than the attenuation ratio of the residual vibration shown in FIG. 9B.

Accordingly, in the case of FIG. 10B, the controller 211 determines that the attenuation ratio of the residual vibration waveform is not within the predetermined range and the state enters the abnormal ejection state.

The case of FIG. 11A shows the state in which the air bubble is mixed into the pressure chamber 27. In FIG. 11B, the amplitude of the first half waveform is almost identical to that in the normal ejection case; the second-half wave and after the second-half wave (second, third half waves) are smaller than those in the normal ejection state.

That is, the damping ratio of the residual vibration shown in FIG. 11B is a little bit greater than that of the residual vibration of FIG. 9B. As is understood from the waveform, when the air bubble is mixed within the pressure chamber 27, the volume of the ink liquid becomes smaller. The frequency (frequency band) of the residual vibration in this state becomes higher than that in the normal state, and the cycle T of the vibration wave becomes shorter.

Accordingly, in the case of FIG. 11B, the controller 211 determines that the attenuation ratio of the residual vibration waveform is not within the predetermined range, and the state enters the abnormal ejection state (abnormal ejection occurs). As is understood from the waveform, the attenuation ratio when the air bubble is mixed within the pressure chamber 27 is further greater than attenuation ratio when the ink is thickened due to drying as shown in FIG. 10B.

In the case of FIG. 12A shows the state in which the liquid pool is generated near the nozzle. In FIG. 12B, the amplitude of the first half waveform is almost identical to that in the normal ejection case; the second half wave and after the second half wave (second, third half waves) are smaller than those in the normal ejection state. That is, the damping ratio of the residual vibration shown in FIG. 12B is a little bit greater than that of the residual vibration of FIG. 9B.

Herein, when the liquid pool is generated near the nozzle 20, the volume of the ink liquid becomes greater. Therefore, the frequency of the residual vibration in this state becomes lower than that in the normal state, and the cycle T of the vibration wave becomes shorter.

Accordingly, in the case of FIG. 12B, the controller 211 determines that the attenuation ratio of the residual vibration waveform is not within the predetermined range, and the state enters the abnormal ejection state (abnormal ejection occurs). As is understood from the waveform, the attenuation ratio when the liquid pool occurs, is greater than the attenuation ratio in the normal ejection state but is smaller than the attenuation ratio when the ink is thickened due to drying as shown in FIG. 10B and that when air bubble is mixed as shown in FIG. 11B.

That is, when the damping ratio of the residual vibration waveform is greater than the predetermined range, the controller 211 determines the occurrence of some ink ejection failure (abnormal ejection).

Accordingly, the controller 211 can determine whether the abnormal ejection occurs in the inkjet recording head 220, based on whether the attenuation ratio of the damping vibration is satisfied within the predetermined range. Thus, it is understood that the attenuation ratio of the damping vibration is related to the ejection feature of the inkjet recording head 220.

Figure 13:
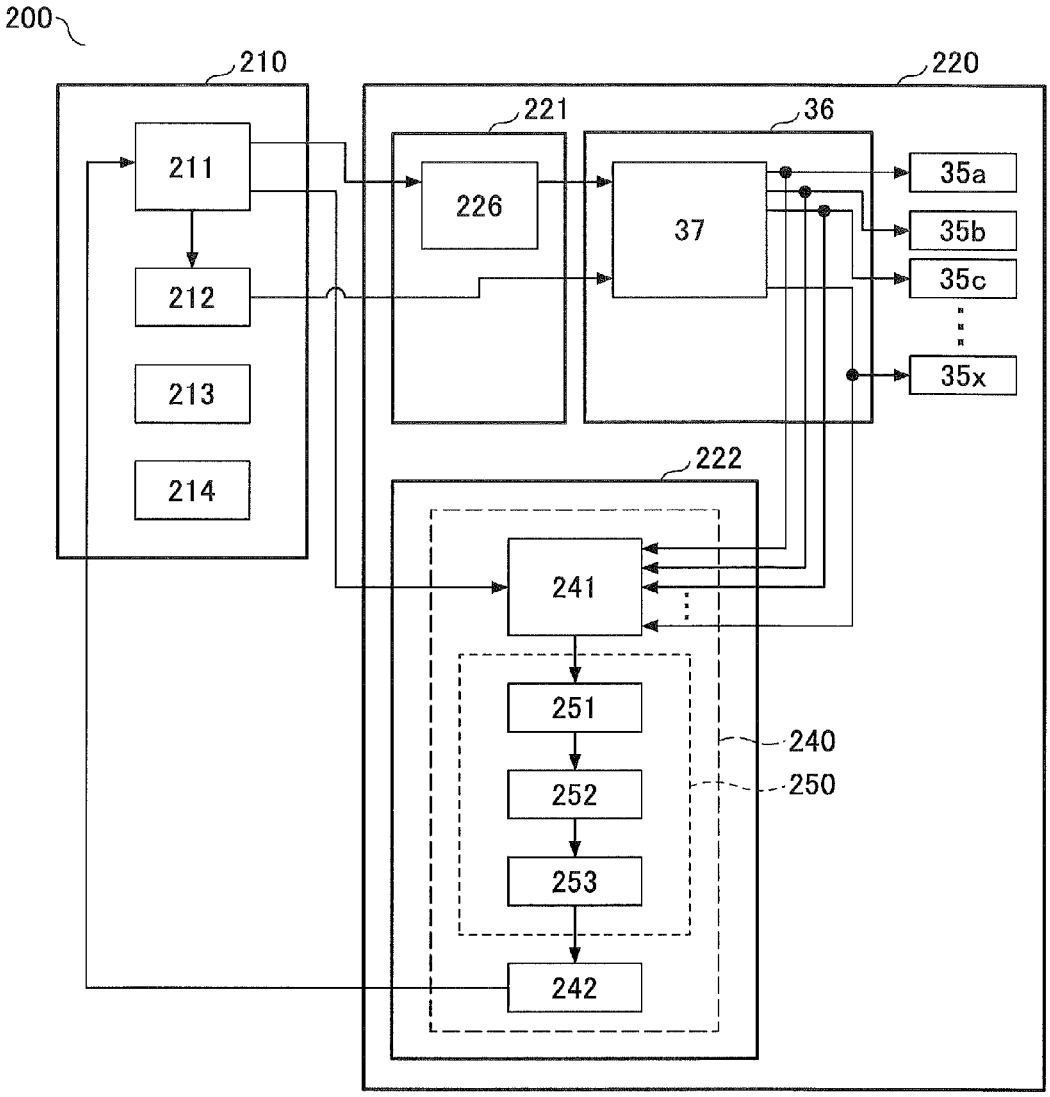
FIG. 13 is an entire block diagram illustrating a drive control of the inkjet recording module according to the first embodiment.

FIG. 13 is an entire block diagram illustrating the inkjet recording module 200 of the present embodiment, to be installed in the inkjet recording apparatus 100.

The inkjet recording module (liquid droplet ejecting device) 200 includes the drive control substrate 210 and the inkjet recording head 220, and so on. The drive control substrate 210 is provided with the controller 211, the drive waveform generator 212, the memory 213, and a page memory 214. The inkjet recording head 220 includes the head substrate 221 to which a controller 226 is installed, the residual vibration detecting substrate 222 to which the residual vibration detector 240 is installed, the piezoelectric element connection substrate 36 to which the piezoelectric driving element IC is installed, and the piezoelectric elements 35 (35*a* through 35*x*). A waveform processing circuit 250, a switching element 241, the waveform processing circuit 250, and an AD converter 242 are installed on the residual vibration detecting substrate 222. The waveform processing circuit 250 includes a filter circuit 251, an amplification circuit 252, and a peak-hold circuit 253.

The entire or a part of functions of the controller 211 installed in the driving control substrate 210 and the controller 226 installed in the head-side substrate 221 may be provided in either one of the substrate 210 or 221 collectively. The entire or a part of functions installed in the residual-vibration detecting substrate 222 may be provided in the drive control substrate 210 or the head-side substrate 221 collectively.

The controller 211 generates a timing control signal and drive wave data, based on the image data transmitted from a host controller (for example, a controller of the inkjet recording apparatus 100), for outputting to the drive waveform generator 212. The controller 211 transmits a timing control signal (digital signal) to the piezoelectric-element driving IC 37 and the switching element 241 via serial communication, and also transmits a switching signal that is synchronized with the timing control signal for transmitting to the switching element 241. By synchronizing the switching signal with the timing control signal, the timing at which fetching the residual vibration voltage that is generated (induced) in the piezoelectric element 35 (electric pad of the piezoelectric element connection substrate 36) after the ink ejection is fetched in the residual-vibration detecting substrate 222 can be controlled.

In addition, the controller 211 selects at least two residual vibrations (multiple cycles) from the output values (for example, digital signal: the amplitude values of the residual vibration held by the peak-hold circuit 253 are converted into digital values). Then, the controller 211 calculates the attenuation ratio of the damping vibration, using the above-mentioned formulas 1 through 4. The more the number of the selected amplitudes, the higher the calculation accuracy of the attenuation ratio.

The controller 211 compares the calculated attenuation ratio with data of the attenuation ratio (correlation between the attenuation ratio and the abnormal states) stored in the memory 213. Thus, the controller 211 determines whether the abnormal ejection occurs in the recording head 220 (the occurrence of the abnormal ejection). Then, the controller 211 causes the maintenance recovery device 114 to perform appropriate maintenance recovery operations, based on the determination result.

For example, when the attenuation ratio is greater than the predetermined value $\zeta abn1$, the controller 211 determines that the air bubble is mixed in the pressure chamber, and causes the suction operation to be performed in the inkjet recording head module 200. For example, when the attenuation ratio is greater than the predetermine value $\zeta max$, the controller 211 causes the flushing operation to be performed in the inkjet recording head module 200. For example, after the flushing operation is performed and when the attenuation ratio is greater than the predetermine value $\zeta abn2$, the controller 211 determines that paper powder is attached (liquid pool is generated) on the surface of the nozzle 20, and causes the wiping operation to be performed.

That is, the controller 211 determines the occurrence of the abnormal operation with a simple circuit configuration, and causes the appropriate maintenance and recovery operation to be performed for the inkjet recording head module 200. Thus, the meniscus (surface) of the ink can be kept at a suitable condition in all the nozzles 20.

The drive waveform generator 212 converts the generated drive wave data from digital to analog, and amplifies a voltage and a current of the analog data.

The memory 213 stores the data relating to the attenuation ratio in advance.

The page memory 214 stores the page for which it is detected the occurrence of the abnormal ejection. By storing the page, the controller 211 predicts that the image failure is printed on the stored page. For example, the page memory 214 stores the page for which it is detected the occurrence of the abnormal ejection in which the air bubble is mixed in the pressure chamber 27. For example, the page memory 214 stores the page for which it is detected the occurrence of the abnormal ejection in which the foreign objects (liquid pool, paper powder) are attached to the surface of the nozzle 20. In addition, for example, the page memory 214 stores the page for which it is detected the occurrence of the abnormal ejection in which the ink viscosity is increased in the pressure chamber 27.

The controller 226 de-serializes the timing control signal for transmitting to the piezoelectric-element driving IC 37.

The piezoelectric-element driving IC 37 is turned ON/OFF in accordance with the state of the timing control signal. For example, in the period during which the piezoelectric-element driving IC 37 is ON, the drive waveform generated in the drive waveform generator 212 is applied to the piezoelectric element 35 (see drive waveform applying period, shown in FIG. 7). In the period during which the piezoelectric-element driving IC 37 is OFF, the drive waveform generated in the drive waveform generator 212 is not applied to the piezoelectric element 35. The piezoelectric element 35 contracts and expands based on the falling and the rising of the drive waveform so as to eject the ink droplets from the respective nozzles in response to the driving of the piezoelectric element 35.

In the waveform processing circuit 250, the filter circuit 251 and the amplification circuit 252 remove the noise (filter process) and amplify the voltage waveforms of the filter-processed waveform. The peak-hold circuit 253 recognizes and extracts peak values (e.g., maximum values) of the amplified waveform and holds the peak values for the predetermined time.

Further, the switching element 241 is connected so that the waveform processing circuit 250 and the piezoelectric elements 35 can be connected and disconnected. For example, when the piezoelectric elements 35 are connected to the waveform processing circuit 250 by the switching element 241, the waveform processing circuit 250 fetches the amplitude values of the residual vibration waveform induced in the electrode of the piezoelectric element connection substrate 36.

The AD converter 242 converts the held amplitude values (analog signal) of the residual vibration held by the wave processing circuit 250 (peak-hold circuit 253) into digital values, for outputting to (feedback) the controller 211. The controller 211 (or the controller 226) calculates the attenuation ratio based on the output of the fed-back residual vibration detector 240 that is fed back from the AD converter 242.

Herein, in FIG. 13, although the residual vibration voltages of the multiple piezoelectric elements 35 are detected by one group of the switching element 241, the waveform processing circuit 250, and the AD converter 242, while switching subsequently; alternatively, the configuration is not limited to that above. For example, multiple groups of switching elements, waveform processing circuits, and the AD converters may be provided so that the number of the groups is the same as the number of the piezoelectric elements 35, and the ink viscosity state of all nozzles (pressure chambers) may be detected at the same time.

Further alternatively, all of the piezoelectric elements 35 are divided into some groups, where a switching element, a waveform processing circuit, and an AD converter are used for each of the groups. Detecting targets may be sequentially switched within the groups. With this configuration, the number of the pressure chambers for which the ink viscosity is detected at the same time can be increased, and the number of the circuits can be reduced.

Figure 14:
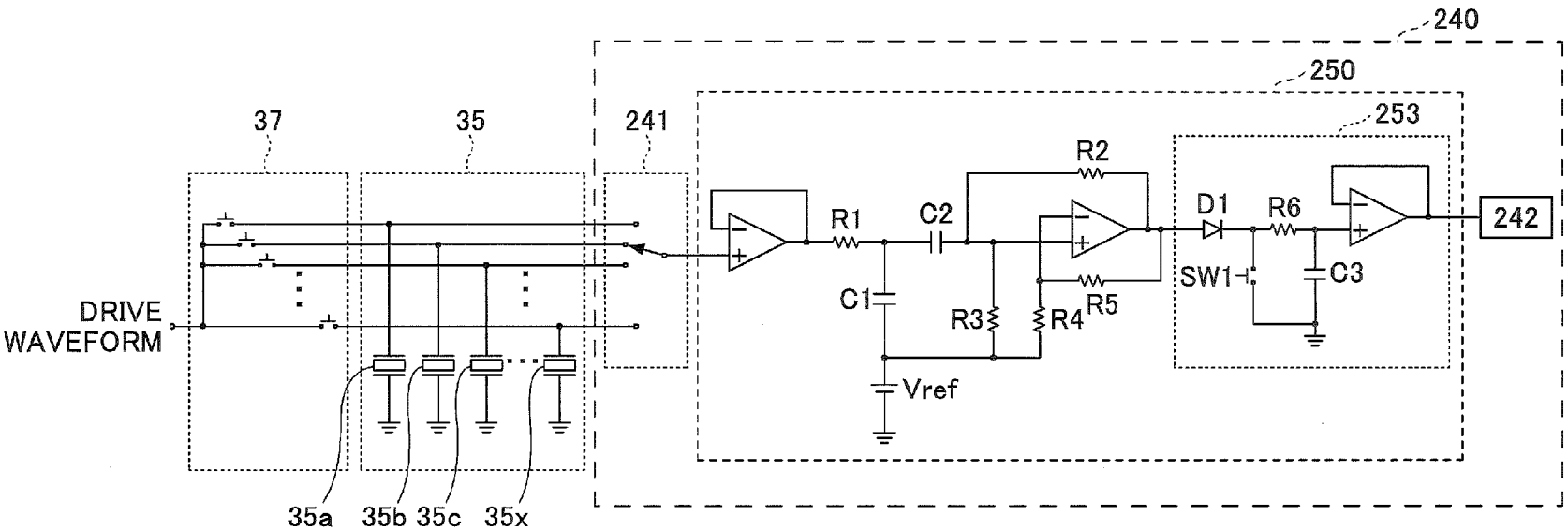
FIG. 14 is circuitry illustrating a residual vibration detecting substrate according to the first embodiment.

FIG. 14 is circuitry illustrating the residual-vibration detector 240 of the present embodiment.

The piezoelectric-element driving IC 37 includes multiple switching elements, and switching ON/OFF of the piezoelectric-element driving IC 37 is based on switching ON/OFF of the switching elements corresponding to the respective piezoelectric elements 35*a* through 35*x*. After the ink has been ejected, at the time when the piezoelectric-element driving IC 37 is turned OFF, the switching element 241 is switched so that the piezoelectric element 35 is connected to the waveform processing circuit 250. By doing so, the waveform processing circuit 250 can recognize the amplitude values of the residual vibration waveform.

In the waveform processing circuit 250, a buffer unit having a high-impedance receives the slightly small residual vibration waveforms, which suppresses adverse effects of the detection circuit (the residual vibration detector 240) to the residual vibration waveforms. Herein, it is preferably configured that passive element constants of resistors R1 through R5 and capacitors C1 through C3, included in the waveform processing circuit 250, be variably controlled by the controller 211, depending on the difference in the natural vibration frequency due to the characteristics of the inkjet recording head 220. In addition, using a simple circuit constituted by a general-purpose operational amplifier, passive elements and switches, the waveform processing circuit 250 can detect the residual vibration. Thus, the increase in the circuit size in the liquid droplet ejecting device can be prevented, which reduces cost.

The filter circuit 251 performs a filter process onto the residual vibration waveform. The filter circuit 251 is designed so that a certain constant passing bandwidth is present, setting a natural vibration frequency as a central frequency. Further, for example, the filter/amplification circuit (251, 252) preferably sets bandwidth of "−3 dB" from both ends of the passing bandwidth so that sensitivity is approximately three times that of the passing bandwidth. With this setting, variation in the natural vibration frequency caused by production tolerance of the head can be absorbed, and the noise in the high frequency band and the low-frequency band can be efficiently removed. Accordingly, removing the noise components efficiently and extracting the signal components can be achieved.

Figure 15:
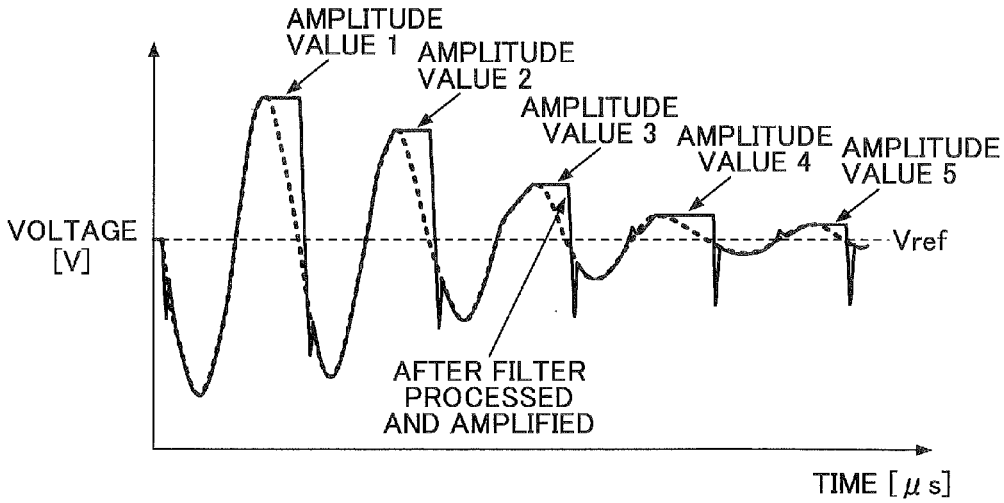
FIG. 15 is a graph illustrating a waveform while amplitude values are detected by using the circuit of FIG. 11 according to the first embodiment.

The amplification circuit 252 amplifies the residual vibration after filter processing (see broken line shown in FIG. 15). An amplification degree of the amplification circuit 252 is set so that the amplified waveforms can be within an input enable range of the AD converter 242.

The filter circuit 251 and the amplification circuit 252 are configured with a band-pass filter amplification type, generally called Sallen-Key type. With this configuration, removing the noise component and abstracting the signal component can be performed effectively. However, the configuration is not limited to that above. The filter circuit and the amplification circuit can be constituted by a combination circuit that includes at least a fitter having high-pass characteristics and low-pass characteristics and a non-inverting amplifier or an inverting amplifier.

The peak-hold circuit 253 recognizes and extracts the peak values of the residual vibration waveform, and holds the value at the peak values. A resistor R6 and a capacitor C3 of the peak-hold circuit 253 control the value (reset value) so that a discharge period is less than (or equal to) one half of the residual vibration cycle. The resistor R6 and the capacitor C3 of the peak-hold circuit 253 control the value (reset value) so that a discharge period is less than (or equal to) one half of the residual vibration cycle.

The reset operation in the peak-hold circuit 253 is performed by transmitting the reset signal from the head-side controller 226 to the switching element 241, for example, at the timing when the rising of the attenuation vibration waveform crosses the reference voltage Vref. The reset timing is the timing as long as peak-hold circuit 253 can recognize the amplitude of the attenuation vibration waveform.

Alternatively, the peak-hold circuit 253 may include or may be connected to a comparator (not shown) that detects the reset timing.

Herein, the circuit configuration of the peak-hold circuit 253 is not limited to the above; if it only includes the function to hold the peak value of the amplitude of the residual vibration waveform, the other configuration is applicable.

FIG. 15 is a graph illustrating an amplified waveform and a peak-hold waveform by using the circuit of FIG. 14 of the present embodiment. In FIG. 15, a broken line represents a waveform of the amplified residual vibration. The solid line represents the experiment waveform of respective half waveforms whose peak is held.

In FIG. 15, five peak values are held. For example, amplitude 1 represents an amplitude of a first half waveform, an amplitude 2 represents an amplitudes of a second first half waveform, an amplitude 3 represents an amplitude of a third half waveform, amplitude 4 represents an amplitude of a fourth half waveform, and amplitude 5 represents an amplitude of a fifth half waveform. The rapid drop of the waveform positioned lower than the reference voltage Vref indicate an undershoot situation caused by instantly discharging the capacitor C3.

The attenuation ratio ζ can be calculated based on at least two amplitude values selected from the five amplitudes 1 through 5, using the above-described formulas (3) and (4). FIG. 15 shows a on waveform detected as first through fifth half waveforms in an upper side of vertical amplitudes (upper amplitude values), and this example, the attenuation ratio ζ is calculated by averaging 4 cycles. Alternatively, the attenuation ratio ζ may be calculated by detecting a lower side of vertical amplitudes (lower amplitude values). When the attenuation ratio ζ may be calculated by detecting the upper side of vertical amplitudes, the waveform processing circuit 250 is constituted by an amplitude circuit method. Alternatively, when the attenuation ratio ζ may be calculated by detecting the lower side of vertical amplitudes, the waveform processing circuit 250 may be constituted by a reverse amplitude circuit method.

Herein, the controller 211 selecting the amplitude values for use appropriately, and therefore, attenuation ratio can be calculated with a higher degree of accuracy. For example, the controller 211 can calculate the attenuation ratio, by excluding the amplitude value of the first half wave that is more likely to be affected by the variation in the switching element 241 and then by averaging the amplitude values after the second half wave (2, 3, 4, 5) per cycle. Alternatively, the attenuation ratio ζ on may be calculated based on the amplitude values (1, 2, 3, 4) for the multiple cycles excluding the smallest amplitude value (smallest absolute value of amplitude) (e.g., amplitude 5 in FIG. 12). With this control, by removing the amplitude having relatively low signal component, the calculated accuracy of the attenuation ratio can be improved. Yet alternatively, by excluding both the amplitude 1 and the amplitude 5, the attenuation ratio ζ may be calculated. Further yet alternatively, the controller 211 can calculate the attenuation ratio, by excluding the amplitude value that is more likely to be affected by a large external disturbance and a loud noise, then by averaging the amplitude values after excluding multiple cycles.

Figure 16:
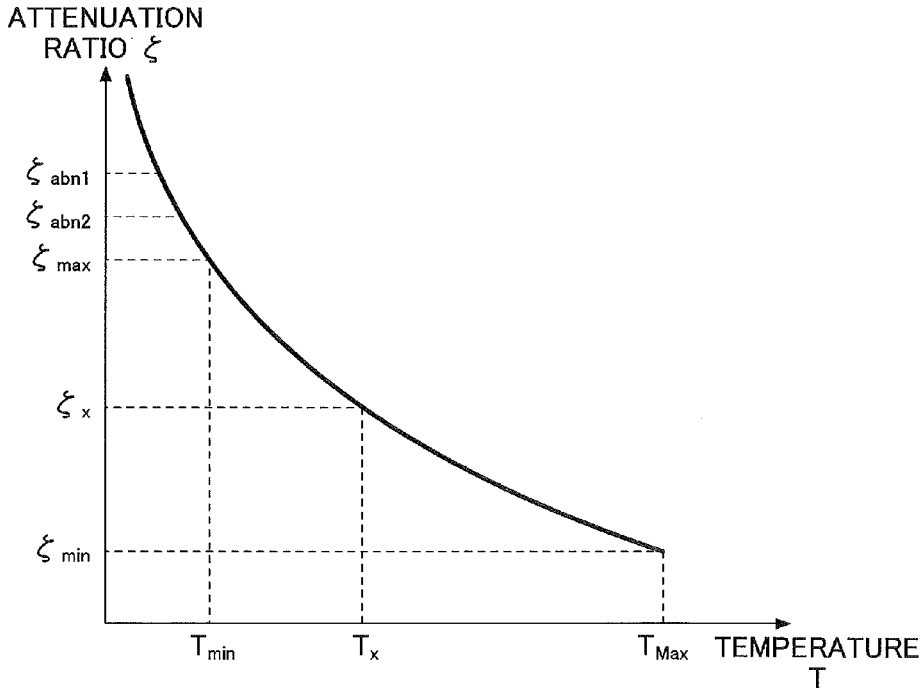
FIG. 16 is a graph illustrating a correlation between the attenuation ratio and ink temperature.

FIG. 16 is a graph illustrating a correlation between the attenuation ratio and temperature. Tmin represents the minimum temperature in a normal ejection enable state, Tmax represents the maximum temperature in the normal ejection enable, and Tx (x: natural number) represents an ambient temperature (thermistor temperature). The ambient temperature Tx is detected by, for example, a temperature sensor (thermistor) provided in the inkjet recording head 220.

The controller 211 sets drive waveform data for respective ambient temperature Tx, and a measured calculated value based on the output of the residual vibration detector after the drive waveform is applied is set to as the attenuation value ζdet. When the state is in the normal ejection, the attenuation rate ζdet is ideally equivalent to ζx (ζdet=ζx)

The temperature range of the normal ejection state of ink is determined. When the temperature is the maximum temperature Tmax, the attenuation ζdet corresponds to the ζmin, and when the temperature is the minimum temperature Tmin, the attenuation ζdet corresponds to the ζmax.

Namely, in the normal ejection state, the attenuation ratio calculated by the controller is within the range ζmin to ζmax shown in FIG. 16. In the abnormal ejection state, the attenuation ratio calculated by the controller 211 is positioned over the range between the ζmin to ζmax, in the vertical direction of the correlation table shown in FIG. 16.

In the present embodiments, as threshold values to determine the abnormal state is set a relation "ζmax (first predetermined value)<ζabn2 (second predetermined value), <ζabn1 (third predetermined value)".

Herein the maximum temperature Tmax corresponding to the attenuation value ζmin, and the minimum temperature Tmin corresponding to the attenuation ratio ζmax are not fixed values. These threshold values are set appropriately.

As described above, by determining whether the calculated attenuation ratio ζdet is in the range from ζmin to ζmax shown in FIG. 16, the controller 211 can determine the occurrence of the abnormal ejection. With this determination, depending on the meniscus, the, suitable maintenance and recovery operations can be achieved for the liquid droplet ejection device.

In the present embodiment of the liquid-droplet ejection device, after the meniscus of the ink is vibrated (slightly driven) so that the ink is not ejected from the nozzle, or after the ink droplet is ejected, the residual vibration of the ink occurring in the pressure chamber is effectively used. The attenuation ratio is calculated from the residual vibration, thereby determining the occurrence of the abnormal ejection.

Thus, by an extremely simple circuit, the occurrence of the abnormal ejection is accurately determined and the suitable maintenance and recovery operation is executed for the nozzle for which it is determined that the maintenance and recovery is needed.

Accordingly, while the reliability of the inkjet recording apparatus having the liquid droplet ejecting device is installed can be maintained, the cost of manufacturing and maintaining the device can be reduced.

<<Control Flowchart>>

Figure 17:
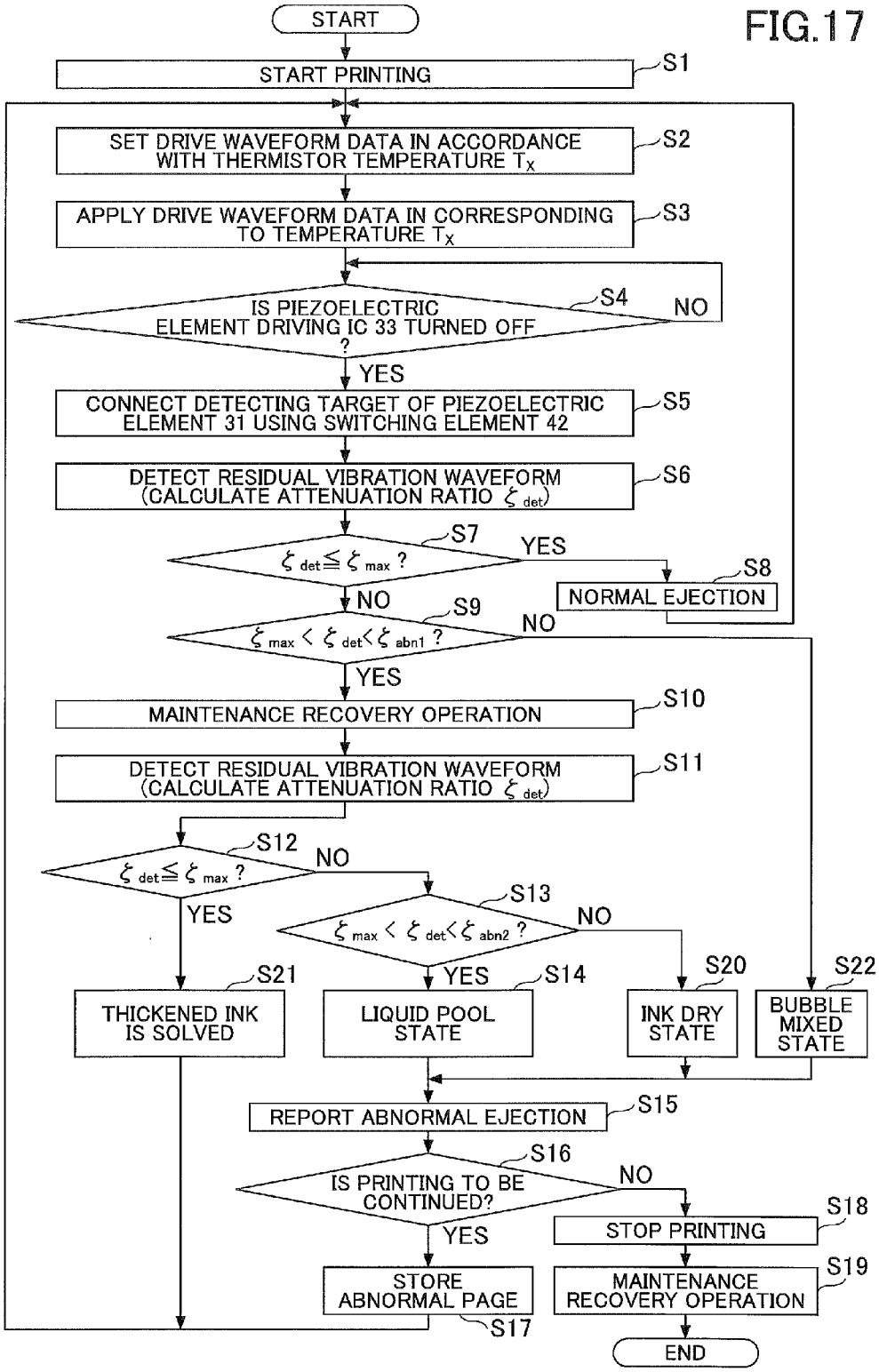
FIG. 17 is a flowchart illustrating operations of an on-demand type, line-scanning inkjet recording system according to the present embodiment.

FIG. 17 is a control flowchart illustrating operations to determine the occurrence of the abnormal ejection performance of the maintenance-recovery operation, in the on-demand type line-scanning inkjet recording apparatus according to the present embodiment. The control flow chart shown in FIG. 17 is executed by the controller 211 depending on the control program.

At step S1, the controller 211 instructs print starting.

At step S2, the controller 211 sets drive waveform data in accordance with an ambient temperature Tx (thermistor temperature).

At step S3, the controller 211 applies the drive waveform (for example, drive voltage waveform) corresponding to the thermistor temperature Tx, to the inkjet recording head 220.

At step S4, the controller 211 monitors the piezoelectric element driving IC 37 and determines whether the piezoelectric element driving IC 37 is turned OFF. On determining that piezoelectric element driving IC 37 is turned OFF (YES), the controller 211 performs the process of step S5. On determining that piezoelectric element driving IC 37 is not turned OFF(NO), the controller 211 continues monitoring the piezoelectric element driving IC 37 (perform the process at step S4 again).

At step S5, the controller 211 causes the piezoelectric elements 35 to connect the waveform processing circuit 250 using the switching element 241.

At step S6, the controller 211 calculates the attenuation ratio ζdet based on the detection result (amplitude values) of the detected residual vibration.

At step S7, the controller 211 determines whether the detected attenuation ratio ζdet is smaller than or equal to the attenuation ratio ζmax (first predetermine value) correlating to the minimum temperature Tmin. Namely, the controller 211 determines that the value of attenuation ratio ζdet satisfies the relation "ζdet≤ζmax".

When it is determined that the value of attenuation ratio ζdet and ζmax satisfy the relation "ζdet≤ζmax" (YES), the process of the controller 211 proceeds to step S8.

When it is not determined that the value of attenuation ratio ζdet satisfies the relation "ζdet≤ζmax" (NO), the process of the controller 211 proceeds to step S9.

When the detected attenuation ratio ζdet is smaller than or equal to the attenuation ratio ζmax (YES, S7), the controller 211 determines that the state of the recording head 22 is in the normal ejection state like that shown in FIG. 9A at step S8. Then, the controller 211 causes the drive waveform generator 212 to apply the drive waveform set for the thermistor temperature Tx correlating to the attenuation ratio ζdet (process returns to step S2 again).

When the detected attenuation ratio ζdet is greater than the attenuation ratio ζmax (NO, S7), at step S9, the controller 211 determines whether the values of attenuation ratio ζdet satisfies the relation "ζmax≤ζdet≤ζabn1" (third threshold value). When it is determined that the value of attenuation ratio ζdet satisfies the relation "ζmax≤ζdet≤ζabn1" (YES), the process of the controller 211 proceeds to step S10. When it is determined that the value of attenuation ratio ζdet does not satisfy the relation "ζmax≤ζdet≤ζabn1 (YES), the process of the controller 211 proceeds to step S22.

When it is determined that the attenuation ratio ζdet is greater than the first predetermined value ζmax and is further greater than the third predetermined value ζabn1, at step S10, the controller 211 performs a flushing operation as the maintenance and recovery operation, using the maintenance recovery device 114.

At step S11, the controller 211 calculates the attenuation ratio ζdet based on the detection result (amplitude values) of the detected residual vibration.

At step S12, the controller 211 determines whether the detected attenuation ratio ζdet is smaller than or equal to the attenuation ratio ζmax (first predetermine value) correlating to the minimum temperature Tmin. Namely, the controller 211 determines that the value of attenuation ratio ζdet satisfies the relation "ζdet≤ζmax". When it is determined that the value of attenuation ratio ζdet satisfy the relation "ζdet≤ζmax" (YES), the process of the controller 211 proceeds to step S21. When it is determined that the value of attenuation ratio ζdet does not satisfy the relation "ζdet≤ζmax" (NO), the process of the controller 211 proceeds to step S13.

When it is determined the value of attenuation ratio ζdet does not satisfy the relation "ζdet≤max" (NO, S12), at step S13, the controller 211 determines whether the values of attenuation ratio ζdet satisfies the relation "ζmax≤ζdet≤ζabn2" (second threshold value).

When it is determined that the values of attenuation ratio ζdet satisfies the relation "ζmax≤ζdet≤ζabn2" (YES), the process of the controller 211 proceeds to step S14. When it is determined that the value of attenuation ratio ζdet does not satisfy the relation "ζmax≤ζdet≤ζabn2" (NO), the process of the controller 211 proceeds to step S20.

When it is determined that the values of attenuation ratio ζdet satisfies the relation "ζmax≤ζdet≤ζabn2" (YES, S13), at step S14, the controller 211 determines that the liquid pool is generated near the nozzle 20 like that shown FIG. 12A, the controller 211 performs the process of the step S15.

At step S15, the controller 211 notifies the on user of the abnormal ejection in which the liquid pool is generated and makes the user confirm whether the printing is to be continued, and the user determines whether the printing is to be continued at step S16.

When it is determined that the printing is to be continued, the controller 211 performs the process at step S17. When it is determined that the printing is to not be continued, the controller 211 performs the process at step S18.

When the printing is to be continued (YES, S16), at step S17, the controller 211 causes the page memory 214 to store the page for which the occurrence of the liquid pool near the nozzle 20 and occurrence of the abnormal ejection are detected.

Then, the controller 211 restarts applying the drive waveform, for thermistor temperature Tx correlating to the attenuation ratio ζdet, to the inkjet recording head 220, from the page for which the occurrence of the abnormal ejection is detected, so as to restart printing (perform step S2 again).

With this control, for example, after the entire printing is finished, the page for which the occurrence of the abnormal ejection is detected can be removed from printing products because there is a possibility to contain the page to which the image failure is printed.

When the printing is not to be continued (NO, S16), at step S18, the controller 211 causes the liquid ejecting device to stop printing.

Then, at step S19, the controller 211 causes the maintenance/recovery device 114 to perform wiping or/sucking operation as the maintenance and recovery operation (that is different from the process at step S10), and then the printing (control flow) is finished (END). Herein, as the maintenance/recovery operation when the liquid pool is generated, the wiping operation is preferable.

At step S13, when the attenuation ratio ζdet is greater than the attenuation ratio ζmax, and is further greater than the attenuation ratio ζabn2 (second predetermined value)(No), the controller 211 determines that the state does not return to the normal ejection state even when flushing operation of the maintenance/recovery operation is performed. That is, the controller 211 determines that the nozzle surface is dried like shown in FIG. 10A.

Then, at step S15, the controller 211 notifies the user of the abnormal ejection in which the liquid pool is generated and makes the user confirm whether the printing is to be continued, and the user determines whether printing is to be continued (S16).

When it is determined that printing is to be continued, the controller 211 causes the page memory 214 to store the page for which the occurrence of the abnormal ejection is detected at step S17, and then restarts printing from the detected page.

When it is determined that printing is not to be continued, the controller 211 stops printing operation at step S18, and then performs maintenance recovery operation (S19). Herein, as for the maintenance recovery operation when the ink is dried, sucking operation is preferable.

In addition, at step S12, when the value of the attenuation ratio ζdet satisfies the relation "ζdet≤ζmax" (YES), at step S21, the controller 211 considers that the state recovers from the abnormal state by performing flushing operation of the maintenance recovery operation at step S10 and considers that the thickened ink (increased ink viscosity) can be dissolved.

Then, the controller 211 restarts applying the drive waveform, for thermistor temperature Tx correlating to the attenuation ratio ζdet, to the inkjet recording head 220, from the page for which on the occurrence of the abnormal ejection is detected, so as to restart printing (perform step S2 again).

Further at step S9, when it is determined that the value of the attenuation ratio ζdet does not satisfy the relation "ζmax<ζdet<ζabn1", that is, the attenuation ratio ζdet is greater than the attenuation ratio ζabn1, the controller 211 determines that the air bubble is mixed in the pressure chamber 27 like that shown in FIG. 11A at step S22. Then, the controller 211 performs the process at step S15.

Then, at step S15, the controller 211 notifies the user of the abnormal ejection in which the air bubble is mixed in the pressure chamber 27, the liquid pool is generated and makes the user confirm whether the printing is to be continued, and the user determines whether printing is to be continued (S16). When it is determined that printing is to be continued, the controller 211 causes the page memory 214 to store the page for which the occurrence of the abnormal ejection is detected at step S17, and then restarts printing (S2). When it is determined that printing is not to be continued, the controller 211 stops printing operation at step S18, and then perform maintenance recovery operation (S19). Herein, as for the maintenance recovery operation when the air bubble is mixed, sucking operation is preferable.

As described above, the controller 211 can accurately determine the occurrence of the abnormal ejection and can appropriate recovery and maintenance operation in accordance with the state of the nozzle 20. In addition, the controller 211 performs simple control such that the occurrence of the abnormal ejection is determined based on the attenuation ratio of the residual vibration, which does not require complicated control or a complicated circuit.

FIGS. 18A through 18D show schematic diagrams illustrating one example of the maintenance recovery operation to recover the state from the abnormal ejection state to the normal ejection state in the inkjet recording head module when the abnormal ejection occurs.

Figure 18A:
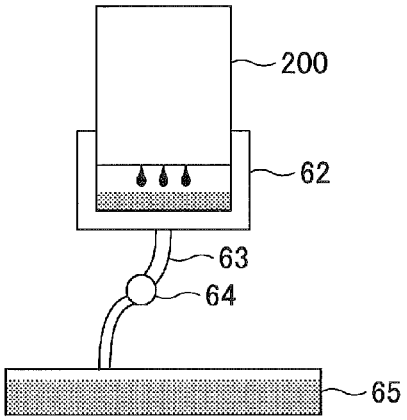
FIG. 18A is a schematic diagram illustrating a suction operation as a maintenance recovery operation.

FIG. 18A is a schematic diagram illustrating a suction operation as the maintenance recovery operation for step S19 shown in FIG. 17. The suction operation is performed, for example, when the air bubble is mixed in the pressure chamber 27. As for the maintenance-recovery device 114, a nozzle cap 62, a tube 63, a tube pump 64 and a discharge ink cartridge 65 are used. The tube 63 functions as an ink discharge pathway during the suction operation, one end of the tube 63 is connected to the bottom of the nozzle cap 62. The other end of the tube 63 is connected to the discharge ink cartridge 65 via the tube pump 64.

The suction operation is the operation where, the tube pump 64 is driven by a driving motor (not shown), and the tube 63 is deformed to generate negative pressure in the tube 63. Thus, the ink in the pressure chamber 27 is suction via the nozzle cap 62, and the suction ink is discharged to the discharge ink cartridge 65 via the tube 63. By the suction operation, the air bubble that is mixed in the pressure chamber 27 can be removed.

Figure 18B:
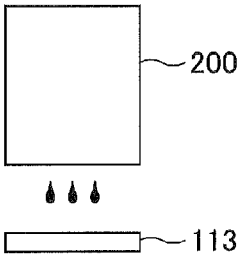
FIG. 18B is a schematic diagram illustrating a flushing operation as the maintenance recovery operation.

FIG. 18B is a schematic diagram illustrating a flushing operation as the maintenance recovery operation for step S10 shown in FIG. 17. The flushing operation is performed, for example, when the ink is thickened in the pressure chamber 27 and when the surface of the nozzle 20 has dried.

The flushing operation is performed during printing operation. By applying a drive waveform that is greater than the normal driving waveform for normal printing to the inkjet recording head module 200, the thickened ink is discharged to the printing surface of the recording medium 113. By performing the flushing operation, even in the printing operation, the ink viscosity can be always kept at an appropriate viscosity.

Figure 18C:
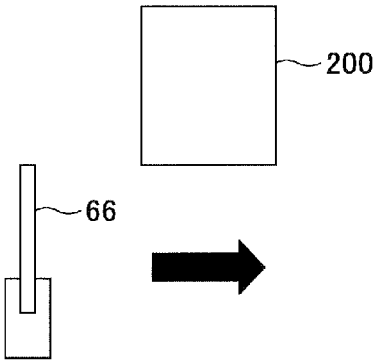
FIG. 18C is a schematic diagram illustrating a wiping operation while an inkjet recording head module is relatively moved to face a wiper as the maintenance recovery operation.
Figure 18D:
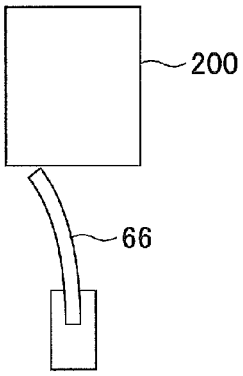
FIG. 18D is a schematic diagram illustrating a wiping operation while a wiper wipes and inkjet recording head module the as the maintenance recovery operation.

FIGS. 18C and 18D are schematic diagrams illustrating a wiping operation as the maintenance recovery operation for step S19 shown in FIG. 17. The wiping operation is performed, for example, when the liquid pool occurs near the nozzle and when the paper powder is attached to the surface of the nozzle 20. As for the maintenance recovery device 114, a wiper 66 is used. The wiper 66 is positioned facing the nozzle 20 of the inkjet recording module 200.

In the wiping operation, a driving mechanism (not shown) moves the inkjet recording module 200 in a direction indicated by an arrow shown in FIG. 18C, and a tip of the wiper 66 cleans the surface of the nozzle 20 (FIG. 18D).

By performing the wiping operation, the foreign objects (liquid pools, paper powder, etc.) attached to the surface of the nozzle 20 can be removed.

Second Embodiment

In a second embodiment, the configuration of the piezoelectric element installed in the inkjet recording head 220 is different from that of the first embodiment. Differing from the piezoelectric elements according to the first embodiment, the piezoelectric element according to the second embodiment includes a driving piezoelectric element and a supporting (pillar) piezoelectric element.

Figure 19:
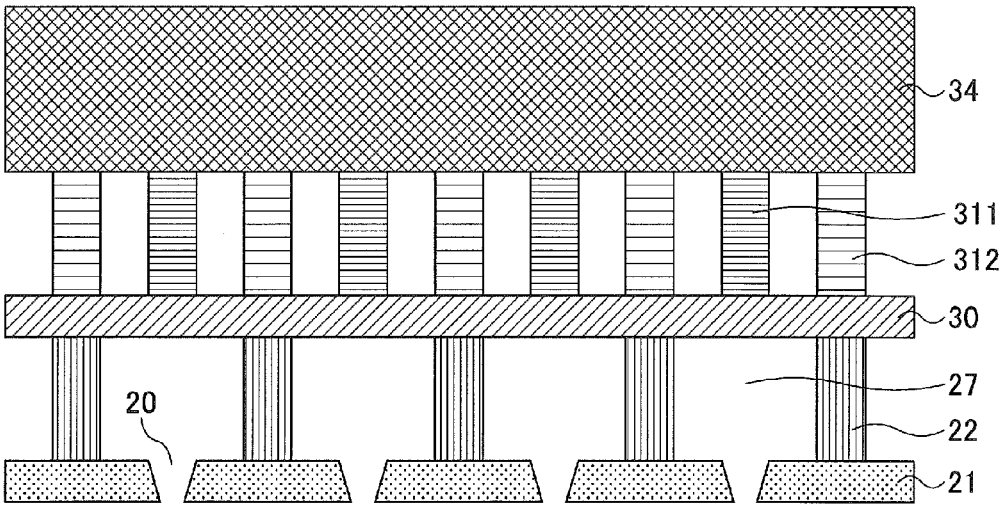
FIG. 19 is a schematic cross-sectional view illustrating one example of the inkjet recording head according to a second embodiment of the present invention.

FIG. 19 is a schematic cross-sectional view illustrating one example of the inkjet recording head 220 according to the second embodiment.

As illustrated in FIG. 19, the piezoelectric elements include driving piezoelectric elements 311 and supporting piezoelectric elements (pillar elements) 312, where the driving piezoelectric elements 311 and the supporting piezoelectric element 312*s* are alternately provided. The driving piezoelectric element 311 is formed in a position facing the openings of the pressure chamber 27 via the vibration plate 30. The supporting piezoelectric element 312 is formed in a position facing partitions of the pressure chamber 27 via the vibration plate 30.

With the configuration of FIG. 19, not only the driving piezoelectric element 311 but also the supporting piezoelectric element 312 can be used for detecting the residual vibration. More specifically, the supporting piezoelectric elements 312 are always used for detecting the residual vibration. In addition, when the piezoelectric element 311 is not being driven (when driving the driving piezoelectric element 311 does not affect the ejection), the driving piezoelectric element 311 may be used for detecting the residual vibration.

Accordingly, in the line scanning type inkjet recording apparatus 100, the flexibility of the timing to detect the residual vibration during printing is increased. Thus, the required time to detect the ink viscosities of the all nozzles 20 (residual vibration detection time) can be shortened. Further, it is unnecessary to provide additional sensors, so the inkjet recording head 220 can have a simple configuration.

Moreover, with the configuration of FIG. 19, even though the position deviation may occur when the vibration plate 30 contacts the piezoelectric elements 311, the character fluctuation occurring in the piezoelectric elements may be minimized. Thus, the splashing performance (ejecting performance) to splash the ink in the inkjet recording head 220 can be made stable.

Herein, although the configuration of the piezoelectric element is not limited to the configuration shown in FIG. 15, the configuration is applicable so that the supporting piezoelectric element 312 can detect the residual vibration, independently from the driving piezoelectric element 311. Alternatively, in order to use all the piezoelectric elements for detecting the residual vibration, additional sensors may be provided.

<Control Flowchart>

Figure 20:
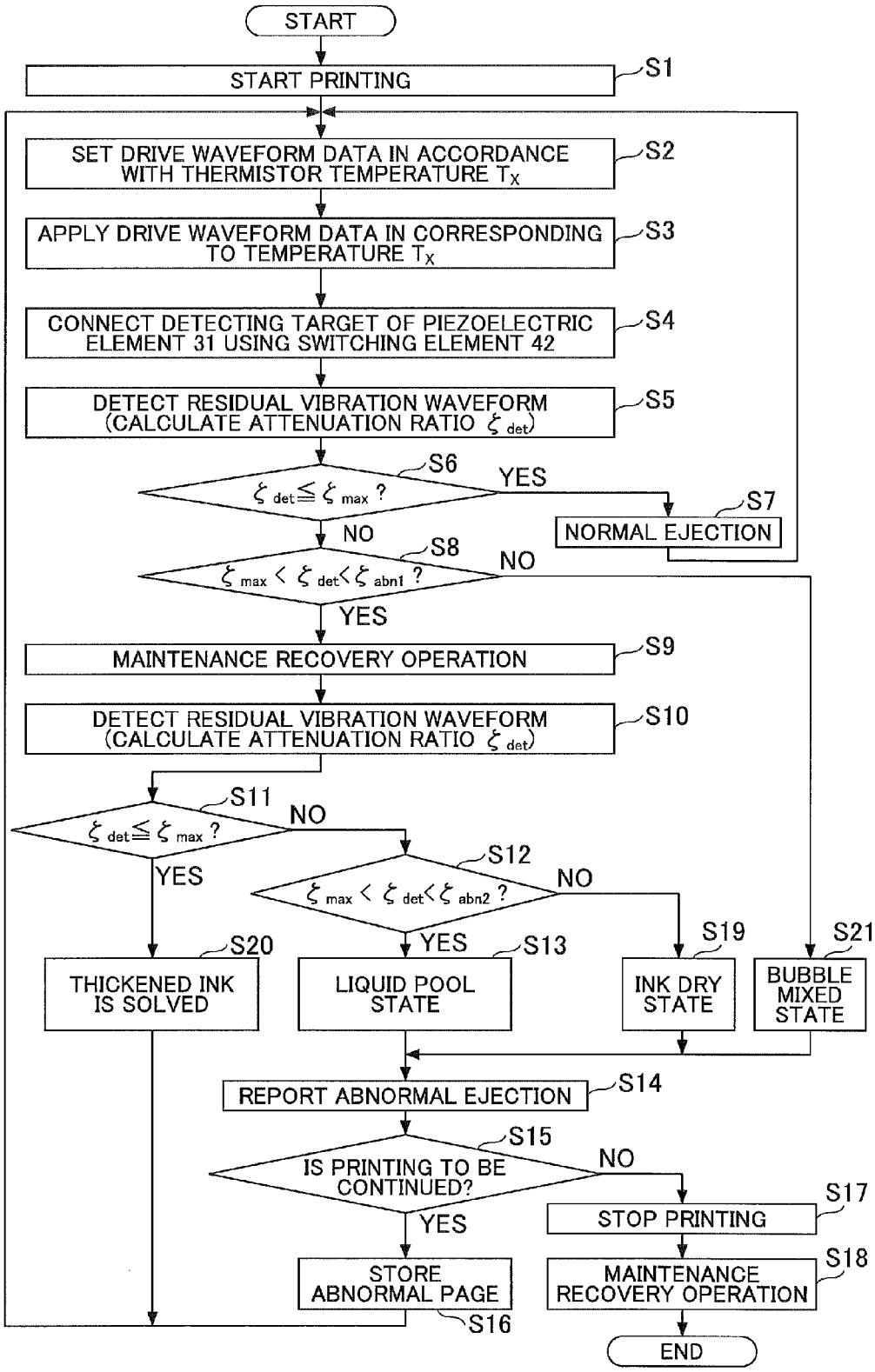
FIG. 20 is a control flowchart illustrating operations of an on-demand type, line-scanning inkjet recording system according to the second embodiment.

FIG. 20 is a control flowchart illustrating operations to determine the occurrence of the abnormal ejection performance of the maintenance-recovery operation, in the on-demand type line-scanning inkjet recording apparatus according to the second embodiment. The control flow chart shown in FIG. 20 is executed by the controller 211 depending on the control program.

At step S1, the controller 211 instructs print starting.

At step S2, the controller 211 sets a drive waveform data in accordance with an ambient temperature Tx (thermistor temperature).

At step S3, the controller 211 applies the drive waveform (for example, drive voltage waveform) correlating to the thermistor temperature Tx, to the inkjet recording head 220.

At step S4, the controller 211 causes the switching elements 241 to connect the piezoelectric element 35 with the wave processing circuit 250. In the present embodiment, using the non-driven piezoelectric element (pillar element) 312 for detecting the residual vibration, since there is no need for monitoring the piezoelectric element driving IC 37 and for determining whether the piezoelectric element driving IC 37 is turned OFF by the controller 211, this control can be made simple.

At step S5, the controller 211 calculates the attenuation ratio $\zeta det$ based on the detection result (amplitude values) of the detected residual vibration.

At step S6, the controller determines whether the detected attenuation ratio $\zeta det$ is smaller than or equal to the attenuation ratio $\zeta max$ (first predetermine value) correlating to the minimum temperature Tmin. Namely, the controller 211 determines that the value of attenuation ratio $\zeta det$ satisfies the relation "$\zeta det \leq \zeta max$". When it is determined that the value of attenuation ratio $\zeta det$ satisfies the relation "$\zeta det \leq \zeta max$" (YES at step S6), the process of the controller 211 proceeds to step S7. When it is determined that the value of attenuation ratio ζdet does not satisfy the relation "ζdet≤ζmax" (NO), the process of the controller 211 proceeds to step S8.

When the detected attenuation ratio ζdet is smaller than or equal to the attenuation ratio ζmax (YES, S6), the controller 211 determines that the state of the recording head 22 is normal with the ejection state like that shown in FIG. 9A at step 7. Then, the controller 211 causes the drive waveform generator 212 to apply the drive waveform set for the thermistor temperature Tx correlating to the attenuation ratio ζdet and perform (return) the process at step S2 again.

When the detected attenuation ratio ζdet is greater than the attenuation ratio ζmax (NO, S6), at step S8, the controller 211 determines whether the values of attenuation ratio ζdet satisfies the relation "ζmax≤ζdet≤ζabn1" (third threshold value). When it is determined that the value of attenuation ratio ζdet satisfies the relation "ζmax≤ζdet≤ζabn1" (YES), the process of the controller 211 proceeds to step S9. When it is determined that the value of attenuation ratio ζdet does not satisfy the relation "ζmax≤ζdet≤ζabn1 (NO, step S8), the process of the controller 211 proceeds to step S21.

When it is determined that the attenuation ratio ζdet is greater than the first predetermined value ζmax and is further greater than the third predetermined value ζabn1 (NO, step S8), at step S9, the controller 211 performs a flushing operation as the maintenance and recovery operation, using the maintenance recovery device 114.

At step S10, the controller 211 calculates the attenuation ratio ζdet based on the detection result (amplitude values) of the detected residual vibration.

At step S11, the controller 211 determines whether the detected attenuation ratio ζdet is smaller than or equal to the attenuation ratio ζmax (first predetermine value) correlating to the minimum temperature Tmin. Namely, the controller 211 determines that the values of attenuation ratio ζdet satisfies the relation "ζdet≤ζmax". When it is determined that the value of attenuation ratio ζdet satisfies the relation "ζdet≤ζmax" (YES), the process of the controller 211 proceeds to step S20. When it is determined that the value of attenuation ratio ζdet does not satisfy the relation "ζdet≤ζmax" (NO), the process of the controller 211 proceeds to step S12.

When it is determined the value of attenuation ratio ζdet does not satisfy the relation "ζdet≤max" (NO, S11), at step S12, the controller 211 determines whether the values of attenuation ratio ζdet satisfies the relation "ζmax≤ζdet≤ζabn2" (second threshold value). When it is determined that the values of attenuation ratio ζdet satisfies the relation "ζmax≤ζdet≤ζabn2" (YES), the process of the controller 211 proceeds to step S13. When it is determined that the value of attenuation ratio ζdet does not satisfy the relation "ζmax≤ζdet≤ζabn2" (NO), the process of the controller 211 proceeds to step S19.

When it is determined that the values of attenuation ratio ζdet satisfies the relation "ζmax≤ζdet≤ζabn2" (YES, S12), at step S13, the controller 211 determines that the liquid pool is generated near the nozzle 20 like that shown FIG. 12A, the controller 211 performs the process of the step S14.

At step S14, the controller 211 notifies the user of the abnormal ejection in which the liquid pool is generated and makes the user confirm whether the printing is to be continued, and the user determines whether the printing is to be continued. When it is determined that the printing is to be continued, the controller 211 performs the process at step S16. When it is determined that the printing is to not be continued, the controller 211 performs the process at step S17.

When the printing is to be continued (YES, S15), at step S16, the controller 211 causes the page memory 214 to store the page for which the occurrence of the liquid pool near the nozzle and occurrence of the abnormal ejection are detected. Then, the controller 211 restarts applying the drive waveform, for thermistor temperature Tx correlating to the attenuation ratio ζdet, to the inkjet recording head 220, from the page for which the occurrence of the abnormal ejection is detected, so as to restart printing (perform step S2 again). With this control, for example, after the entire printing is finished, the page for which the occurrence of the abnormal ejection is detected can be removed from printing products because there is a possibility to contain the page to which the image failure is printed.

When the printing is not to be continued (NO, S15), at step S17, the controller 211 causes the liquid ejecting device to stop printing.

Then, at step S18, the controller 211 causes the maintenance/recovery device 114 to perform wiping or/sucking operation as the maintenance and recovery operation (that is different from the process at step S9), and then the printing (control flow) is finished (END). Herein, as the maintenance/recovery operation when the liquid pool is generated, the wiping operation is preferable.

At step S12, when the attenuation ratio ζdet is greater than the attenuation ratio ζmax, and is further greater than the attenuation ratio ζabn2 (second predetermined value)(No), the controller 211 determines that the state does not return to the normal ejection state even when flushing operation of the maintenance/recovery operation is performed. That is, the controller 211 determines that the nozzle surface is dried like shown in FIG. 10A.

Then, at step S14, the controller 211 notifies the user of the abnormal ejection in which the liquid pool is generated, and makes the user confirm whether the printing is to be continued, and the user determines whether printing is to be continued (S15). When it is determined that printing is to be continued, at step S16, the controller 211 causes the page memory 214 to store the page for which the occurrence of the abnormal ejection is detected and then restarts printing from the detected page. When it is determined that printing is not to be continued, at S17, the controller 211 stops printing operation, and then perform maintenance recovery operation (S18). Herein, as for the maintenance recovery operation when the ink is dried, sucking operation is preferable.

In addition, at step S11, when the value of the attenuation ratio ζdet satisfies the relation "ζdet≤ζmax" (YES), at step S20, the controller 211 considers that the state recovers from the abnormal state by performing flushing operation of the maintenance recovery operation at step S10 and considers that the thickened ink (increased ink viscosity) can be dissolved. Then, the controller 211 restarts applying the drive waveform, for thermistor temperature Tx correlating to the attenuation ratio ζdet, to the inkjet recording head 220, from the page for which the occurrence of the abnormal ejection is detected, so as to restart printing (perform step S2 again).

Further at step S8, when it is determined that the value of the attenuation ratio ζdet does not satisfy the relation "ζmax<ζdet<ζabn1", that is, the attenuation ratio ζdet is greater than the attenuation ratio ζabn1, at step S21, the controller 211 determines that the air bubble is mixed in the pressure chamber 27 like that shown in FIG. 11A, the controller perform the process at step S15.

Then, at step S14, the controller 211 notifies the user of the abnormal ejection in which the air bubble is mixed in the pressure chamber 27, the liquid pool is generated and makes the user confirms whether the printing is to be continued or not, and the user determines whether printing is to be continued or not (S15). When it is determined that printing is to be continued, at step S17, the controller 211 causes the page memory 214 to store the page for which the occurrence of the abnormal ejection is detected and then restarts printing (S2). When it is determined that printing is not to be continued, at S17, the controller 211 stops printing operation, and then perform maintenance recovery operation (S18). Herein, as for the maintenance recovery operation when the air bubble is mixed, sucking operation is preferable.

As described above, when the controller 211 uses the non-piezoelectric elements for detecting the residual vibration, without using the complicated circuit, the occurrence of the abnormal ejection can be determined with a higher degree of accuracy even in the printing. Thus, the increase in the circuit size in the liquid droplet ejecting device can be restricted.

The present invention is not limited to the specifically disclosed embodiments, and variations and modifications may be made without departing from the scope of the present invention. The scope of the inventive subject matter should be determined with reference to the appended claims, along with the full scope of equivalents to which such claims are entitled.

What is claimed is:

1. A liquid droplet ejecting device comprising:

multiple pressure chambers communicating with multiple nozzles, to contain liquid;

a vibration plate, disposed extending along the pressure chambers;

multiple piezoelectric elements disposed facing the multiple chambers respectively via the vibration plate;

a drive waveform generator to generate drive voltage for the piezoelectric elements;

a residual vibration detector to detect an amplitude of a residual vibration waveform occurring within the pressure chamber after the piezoelectric elements are driven; and a controller to calculate a damping ratio of the residual vibration waveform detected by the residual vibration detector based on a plurality of the detected amplitudes of the residual vibrations, and to determine whether abnormal ejection occurs based on the calculated dampening ratio;

wherein predetermined values are set to a relation "a first predetermined value<a second predetermined value<a third predetermined value", wherein the controller determines that an air bubble is mixed in the pressure chamber, upon detecting that the damping ratio is greater than or equal to the third predetermined value.

2. The liquid droplet ejecting device as claimed in claim 1, wherein, upon detecting that the damping ratio is greater than the first predetermined value and is smaller than the third predetermined value, the controller causes a flushing operation to be performed in the liquid droplet ejecting device, wherein, upon detecting that the damping ratio after the flushing operation is performed is smaller than or equal to the first predetermined value, the controller determines a phenomenon that thickened ink whose viscosity is increased is dissolved.

3. The liquid droplet ejecting device as claimed in claim 1, wherein, upon detecting that the damping ratio is greater than the first predetermined value and is smaller than the third predetermined value, the controller causes a flushing operation to be performed in the liquid droplet ejecting device, wherein, upon detecting that the damping ratio after the flushing operation is performed is greater than the first predetermined value and is smaller than the second predetermined value, the controller determines that a liquid pool is generated near the nozzles.

4. The liquid droplet ejecting device as claimed in claim 1, wherein, upon detecting that the damping ratio is greater than the first predetermined value and is smaller than the third predetermined value, the controller causes a flushing operation to be performed in the liquid droplet ejecting device, wherein, upon detecting that the damping ratio after the flushing operation is performed is greater than the first predetermined value and is greater than or equal to the second predetermined value, the controller determines that the viscosity of the ink is increased and the ink is dried.

5. The liquid droplet ejecting device as claimed in claim 1, wherein the residual vibration detector detects upper amplitude values of multiple cycles of the residual vibration waveform.

6. The liquid droplet ejecting device as claimed in claim 1, wherein the residual vibration detector detects lower amplitude values of multiple cycles of the residual vibration waveform.

7. The liquid droplet ejecting device as claimed in claim 1, wherein the residual vibration detector detects amplitude values of multiple cycles of the residual vibration waveform excluding a first half wave.

8. The liquid droplet ejecting device as claim in claim 1, wherein the residual vibration detector selectively detects amplitude values of multiple cycles of the residual vibration.

9. The liquid droplet ejecting device as claimed in claim 1, wherein the residual vibration detector comprises a filter circuit that includes a band-pass filter with a constant pass bandwidth.

10. The liquid droplet ejecting device as claimed in claim 9, wherein a receptive constant of passive element in the filter circuit is variably controlled by the controller.

11. The liquid droplet ejecting device as claimed in claim 9, wherein the residual vibration detector comprises:

a switching element: and a waveform processing circuit that is connected to two or more piezoelectric elements via the switching element.

12. The liquid droplet ejecting device as claimed in claim 9, further comprising a selecting unit to cause a user to select whether a printing operation is to be continued or stopped when the abnormal ejection occurs.

13. The liquid droplet ejecting device as claimed in claim 12, further comprising a memory to store a page for which the occurrence of the abnormal ejection is detected.

14. An inkjet recording apparatus comprising:

the liquid droplet ejecting device as claimed in claim 1.

15. The inkjet recording apparatus as claimed in claim 14, further comprising:

a suction device to suction the ink in the nozzle when the controller determines that the air bubble is mixed in the pressure chamber, and that the ink viscosity is increased due to drying.

16. The inkjet recording apparatus as claimed in claim 14, further comprising:

a wiping device to wipe a surface of the nozzle when the controller determines that the liquid pool is generated near the nozzle.

17. A liquid droplet ejecting method for a liquid droplet ejecting device as claimed in claim 1, comprising:

setting a relation "a first predetermined value<a second predetermined value<a third predetermined value";

calculating a damping ratio of the residual vibration;

detecting whether the damping ratio is smaller than or equal to the first predetermined value;

detecting whether the damping ratio is greater than the first predetermined value and is smaller than or equal to the third predetermined value;

performing a flushing operation in the liquid droplet ejecting device, upon detecting that the damping ratio is greater than the first predetermined value and is smaller than or equal to the third predetermined value;

detecting whether the damping ratio after the flushing operation is performed is smaller than or equal to the first predetermined value; and detecting whether the damping ratio after the flushing operation is performed is greater than the first predetermined value and smaller than the second predetermined value.

18. A non-transition computer-readable storage medium storing a program which, when executed by a liquid droplet ejecting device performs for executing a liquid droplet ejecting method as claimed in claim 17, comprising:

setting a relation "a first predetermined value<a second predetermined value<a third predetermined value";

calculating a damping ratio of the residual vibration;

detecting whether the damping ratio is smaller than or equal to a first predetermined value;

detecting whether the damping ratio is greater than the first predetermined value and is smaller than or equal to the third predetermined value;

performing a flushing operation in the liquid droplet ejecting device, upon detecting that the damping ratio is greater than the first predetermined value and is smaller than or equal to the third predetermined value;

detecting whether the damping ratio after the flushing operation is performed is smaller than or equal to the first predetermined value; and detecting whether the damping ratio after the flushing operation is performed is greater than the first predetermined value and smaller than the second predetermined value.

19. A method operable by a liquid droplet ejecting device comprising multiple pressure chambers communicating with multiple nozzles that contain liquid, a vibration plate disposed extending along the pressure chambers, and multiple piezoelectric elements disposed facing the multiple chambers respectively via the vibration plate, the method comprising:

generating, by a drive waveform generator of the liquid droplet ejecting device, a drive voltage for the piezoelectric elements;

detecting, by a residual vibration detector of the liquid droplet ejecting device, an amplitude of a residual vibration waveform occurring within the pressure chamber after the piezoelectric elements are driven;

calculating, by a controller of the liquid droplet ejecting device, a damping ratio of the residual vibration waveform detected by the residual vibration detector based on a plurality of the detected amplitudes of the residual vibrations;

determining, by the controller, whether abnormal ejection occurs based on the calculated dampening ratio, wherein predetermined values are set to a relation "a first predetermined value<a second predetermined value<a third predetermined value"; and determining, by the controller, that an air bubble is mixed in the pressure chamber, upon detecting that the damping ratio is greater than or equal to the third predetermined value.

* * * * *